US010701506B2

(12) United States Patent
Badhwar et al.

(10) Patent No.: US 10,701,506 B2
(45) Date of Patent: Jun. 30, 2020

(54) PERSONALIZED HEAD RELATED TRANSFER FUNCTION (HRTF) BASED ON VIDEO CAPTURE

(71) Applicant: EmbodyVR, Inc., San Mateo, CA (US)

(72) Inventors: Shruti Badhwar, San Mateo, CA (US); Nikhil Ratnesh Javeri, Sunnyvale, CA (US); Faiyadh Shahid, San Mateo, CA (US); Kapil Jain, Redwood City, CA (US)

(73) Assignee: EmbodyVR, Inc., San Mateo, CA (US)

( * ) Notice: Subject to any disclaimer, the term of this patent is extended or adjusted under 35 U.S.C. 154(b) by 0 days.

(21) Appl. No.: 16/138,931

(22) Filed: Sep. 21, 2018

(65) Prior Publication Data

US 2019/0045317 A1 Feb. 7, 2019

Related U.S. Application Data

(63) Continuation-in-part of application No. 15/811,441, filed on Nov. 13, 2017, now Pat. No. 10,433,095.
(Continued)

(51) Int. Cl.
*H04S 7/00* (2006.01)
*H04S 1/00* (2006.01)

(52) U.S. Cl.
CPC ..... *H04S 7/302* (2013.01); *H04S 1/005* (2013.01); *H04S 2400/15* (2013.01); *H04S 2420/01* (2013.01)

(58) Field of Classification Search
CPC ..... H04S 7/302; H04S 7/303; H04S 7/301; H04S 7/304; H04S 2420/01; G06K 9/00221
See application file for complete search history.

(56) References Cited

U.S. PATENT DOCUMENTS 5,708,725 A 1/1998 Ito
9,030,545 B2 5/2015 Pedersen
(Continued)

FOREIGN PATENT DOCUMENTS

JP 3521900 B2 4/2004
KR 20150009384 A 1/2015
WO 2017047309 A1 3/2017

OTHER PUBLICATIONS

Abaza et al., A survey on ear biometrics, Feb. 2013, A survey on ear biometrics. ACM Comput. Surv. 45, 2, Article 22, 35 pages (Year: 2013).*

(Continued)

*Primary Examiner* — Md S Elahee
*Assistant Examiner* — Angelica M McKinney

(57) ABSTRACT

A video is received from a video capture device. The video capture device has a front facing camera and a display screen which displays the video captured by the video capture device in real time to a user. One or more images of a pinna and head of the user in the video are used to automatically determine one or more features associated with the user. The one or more features include an anatomy of the user, a demographic of the user, a latent feature of the user, and an indication of an accessory worn by the user. Based on the one or more features and one or more HRTF models, a head related transfer function (HRTF) is determined which is personalized to the user.

22 Claims, 21 Drawing Sheets

Related U.S. Application Data

(60) Provisional application No. 62/588,178, filed on Nov. 17, 2017, provisional application No. 62/468,933, filed on Mar. 8, 2017, provisional application No. 62/466,268, filed on Mar. 2, 2017, provisional application No. 62/424,512, filed on Nov. 20, 2016, provisional application No. 62/421,380, filed on Nov. 14, 2016, provisional application No. 62/421,285, filed on Nov. 13, 2016.

(56) References Cited

U.S. PATENT DOCUMENTS

| | | | | |
|---|---|---|---|---|
| 9,473,858 | B2 | 10/2016 | Pedersen et al. | |
| 9,544,706 | B1 * | 1/2017 | Hirst | H04S 7/302 |
| 9,900,722 | B2 | 2/2018 | Bilinski et al. | |
| 10,181,328 | B2 | 1/2019 | Jensen et al. | |
| 10,200,806 | B2 | 2/2019 | Stein et al. | |
| 2006/0067548 | A1 | 3/2006 | Slaney et al. | |
| 2006/0193515 | A1 * | 8/2006 | Kim | G06K 9/00228 382/173 |
| 2006/0274901 | A1 | 12/2006 | Terai et al. | |
| 2008/0175406 | A1 | 7/2008 | Smith | |
| 2011/0009771 | A1 | 1/2011 | Guillon et al. | |
| 2012/0183161 | A1 * | 7/2012 | Agevik | H04S 7/302 381/303 |
| 2012/0328107 | A1 | 12/2012 | Nystrom et al. | |
| 2013/0169779 | A1 * | 7/2013 | Pedersen | G06K 9/00362 348/77 |
| 2013/0177166 | A1 | 7/2013 | Agevik et al. | |
| 2013/0279724 | A1 | 10/2013 | Stafford et al. | |
| 2014/0161412 | A1 | 6/2014 | Chase et al. | |
| 2015/0010160 | A1 * | 1/2015 | Udesen | H04R 25/70 381/60 |
| 2017/0020382 | A1 | 1/2017 | Sezan et al. | |
| 2017/0332186 | A1 | 11/2017 | Riggs et al. | |
| 2018/0091921 | A1 * | 3/2018 | Silva | H04S 7/304 |

OTHER PUBLICATIONS

PCT Application Serial No. PCT/2018/052312, International Search Report dated Jan. 21, 2019., 3 pages.
International Application Serial No. PCT/2018/052312, Written Opinion dated Jan. 21, 2019., 7 pages.
International Application Serial No. PCT/US2017/061417, International Search Report dated Mar. 5, 2018, 3 pages.
International Application Serial No. PCT/US2017/061417, Written Opinion dated Mar. 5, 2018, 8 pages.
Spagnol, et al., "Synthetic Individual Binaural Audio Delivery by Pinna Image Processing", International Journal of Pervasive Computing and Communications vol. 10 No. 3, 2014, pp. 239-254, Emerald Group Publishing Limited.
U.S. Appl. No. 15/811,295, Non-Final Office Action, dated Aug. 9, 2018, 13 pages.
U.S. Appl. No. 15/811,295, Notice of Allowance, dated Feb. 27, 2019, 6 pages.
U.S. Appl. No. 15/811,392, Non-Final Rejection, dated Feb. 13, 2019, 9 pages.
U.S. Appl. No. 15/811,392, Notice of Allowance, dated May 30, 2019, 9 pages.
U.S. Appl. No. 16/542,930, Non-Final Office Action, dated Nov. 27, 2019, 11 pages.

* cited by examiner

PERSONALIZED HEAD RELATED TRANSFER FUNCTION (HRTF) BASED ON VIDEO CAPTURE

RELATED DISCLOSURE

This disclosure claims the benefit of priority under 35 U.S.C. § 119(e) to U.S. Provisional Patent Application Ser. No. 62/588,178 entitled "In-Field HRTF Personalization Through Auto-Video Capture" filed Nov. 17, 2017, the contents of which are herein incorporated by reference in its entirety.

This disclosure claims the benefit of priority under 35 U.S.C. § 120 as a continuation in part to U.S. patent application Ser. No. 15/811,441 entitled "System and Method to Capture Image of Pinna and Characterize Human Auditory Anatomy Using Image of Pinna" filed Nov. 13, 2017, which claims the benefit of priority under 35 U.S.C. § 119(e) of U.S. Provisional Application No. 62/421,380 filed Nov. 14, 2016 entitled "Spatially Ambient Aware Audio Headset", U.S. Provisional Application No. 62/424,512 filed Nov. 20, 2016 entitled "Head Anatomy Measurement and HRTF Personalization", U.S. Provisional Application No. 62/468,933 filed Mar. 8, 2017 entitled "System and Method to Capture and Characterize Human Auditory Anatomy Using Mobile Device, U.S. Provisional Application No. 62/421,285 filed Nov. 13, 2016 entitled "Personalized Audio Reproduction System and Method", and U.S. Provisional Application No. 62/466,268 filed Mar. 2, 2017 entitled "Method and Protocol for Human Auditory Anatomy Characterization in Real Time", the contents each of which are herein incorporated by reference in their entireties.

FIELD OF DISCLOSURE

The disclosure is related to consumer goods and, more particularly, to methods, systems, products, features, services, and other elements for personalizing an HRTF based on video capture.

BACKGROUND

A human auditory system includes an outer ear, middle ear, and inner ear. A sound source such as a loudspeaker in a room may output sound. A pinna of the outer ear receives the sound, directs the sound to an ear canal of the outer ear, which in turn directs the sound to the middle ear. The middle ear transfers the sound from the outer ear into fluids of the inner ear for conversion into nerve impulses. A brain then interprets the nerve impulses to hear the sound. Further, the human auditory system perceives a direction where the sound is coming from. The perception of direction of the sound source is based on interactions with human anatomy. This interaction, includes sound reflecting, scattering and/or diffracting with the outer ear, head, shoulders, and torso to generate audio cues decoded by the brain to perceive the direction where the sound is coming from.

It is now becoming more common to listen to sounds wearing personalized audio delivery devices such as headphones, hearables, earbuds, speakers, or hearing aids. The personalized audio delivery devices outputs sound, e.g., music, into the ear canal of the outer ear. For example, a user wears an earcup seated on the pinna which outputs the sound into the ear canal. Alternatively, a bone conduction headset vibrates middle ear bones to conduct the sound to the human auditory system. The personalized audio delivery devices accurately reproduce sound. But unlike sound from a sound source, the sound from the personalized audio delivery devices does not interact with the human anatomy such that direction where the sound is coming from is accurately perceptible. The seating of the earcup on the pinna prevents the sound from interacting with the pinna and the bone conduction may bypass the pinna altogether. Audio cues are not generated and as a result the user is not able to perceive the direction where the sound is coming from.

To spatialize and externalize the sound while wearing the personalized audio delivery device, the audio cues can be artificially generated by a head related transfer function (HRTF). The HRTF is a transfer function which describes the audio cues for spatializing the sound in a certain location for a user. For example, the HRTF describes a ratio of sound pressure level at the ear canal to the sound pressure level at the head that facilitates the spatialization. In this regard, the HRTF is applied to sound output by the personal audio delivery device to spatialize the sound output in the certain location even though the sound does not interact with the human anatomy. HRTFs are unique to a user because the human anatomy between people differ. The HRTF which spatializes sound in one location for one user will spatialize and externalize sound in another location for another user.

BRIEF DESCRIPTION OF THE DRAWINGS

Features, aspects, and advantages of the presently disclosed technology may be better understood with regard to the following description, appended claims, and accompanying drawings where:

Figure 1:
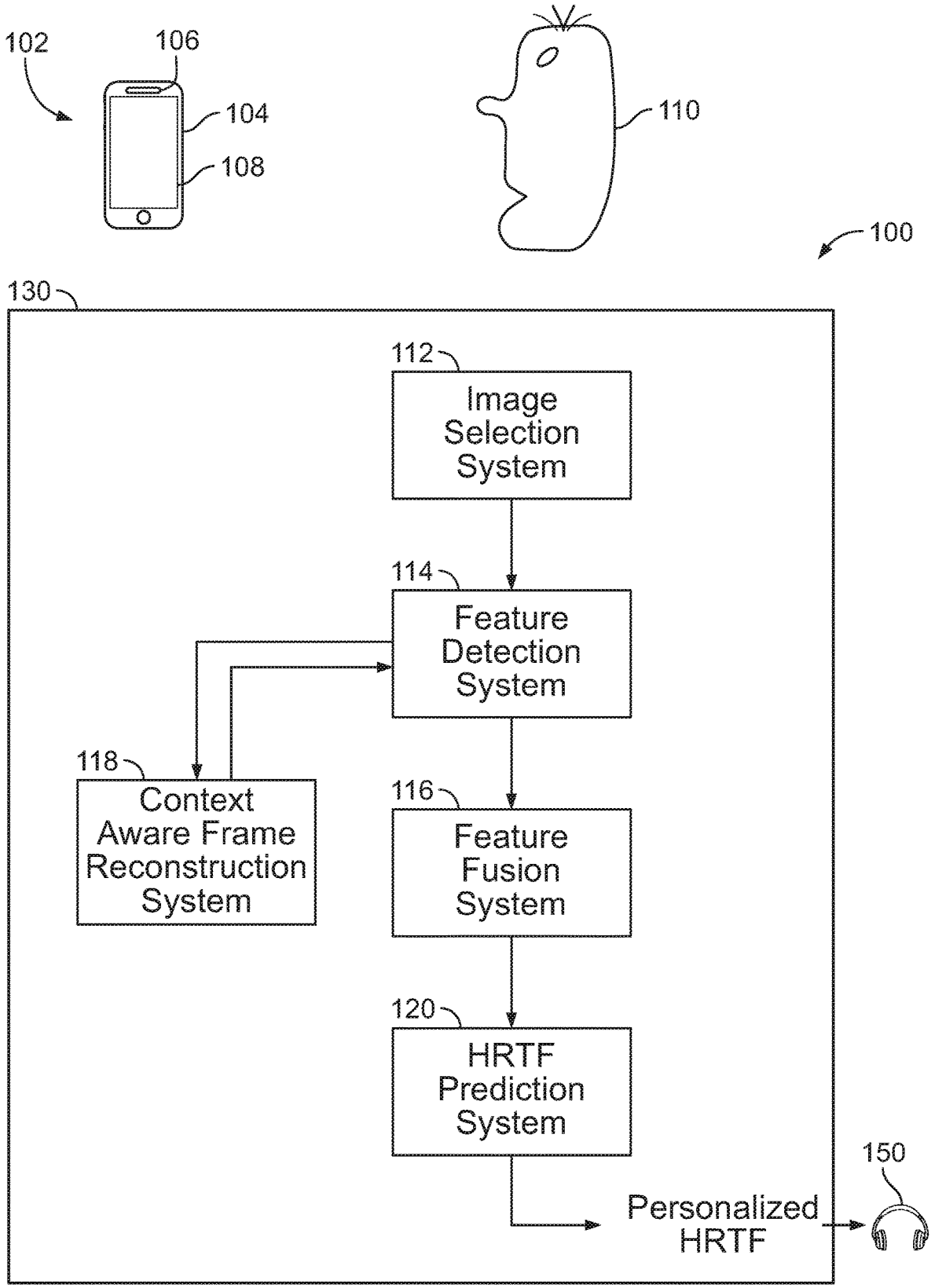
FIG. 1 shows an example system for determining a personalized HRTF based on a video capture of a user.

The drawings are for the purpose of illustrating example embodiments, but it is understood that the embodiments are not limited to the arrangements and instrumentality shown in the drawings.

DETAILED DESCRIPTION

The description that follows includes example systems, methods, techniques, and program flows that embody embodiments of the disclosure. However, it is understood that this disclosure may be practiced without these specific details. For instance, this disclosure refers to determining an HRTF personalized for a user based on video capture in illustrative examples. Embodiments of this disclosure can be applied in other contexts as well. In other instances, well-known instruction instances, protocols, structures and techniques are not shown in detail in order to not obfuscate the description.

Overview

Embodiments described herein are directed to a systems, apparatuses, and methods for personalizing an HRTF to spatialize sound for a user based on video capture. A video capture device has a camera and display screen facing in substantially a same direction as a user to allow the user to capture video of his anatomy by the camera while simultaneously being able to view in real time what is being recorded on the display screen. An image selection system analyzes images of the captured video for those images containing features of importance and/or meeting various image quality metrics such as contrast, clarity, sharpness etc. A feature detection system analyzes the images to determine those features which impact HRTF prediction, including but not limited to one or more of an anatomy of a user, demographics of the user, accessories worn by the user, and/or latent features of the user. In some cases, a 3D representation of the user is used to determine the features. If the user is wearing an accessory, the 3D representation includes the accessory and/or the 3D representation of the user without the accessory. The features are provided to a feature fusion system which combines the different features determined by the feature detection system to facilitate determining the HRTF of the user. An HRTF prediction system then finds a best matching HRTF for the determined features which is personalized to the user. The personalized HRTF is applied to sound output by a personal audio delivery device. In this regard, the personal audio delivery device is able to spatialize the sound so that the user perceives the sound as coming from a certain direction.

The description that follows includes example systems, apparatuses, and methods that embody aspects of the disclosure. However, it is understood that this disclosure may be practiced without these specific details. In other instances, well-known instruction instances, structures and techniques have not been shown in detail in order not to obfuscate the description.

Example Illustrations

FIG. 1 is an example system 100 for sound spatialization based on personalizing an HRTF for a user based on various features of the user. The system 100 may include a video capture system 102, an HRTF personalization system 130, and a personal audio delivery device 150.

The video capture system 102 may have a video capture device 104 taking the form of a mobile phone, digital camera, or laptop device. The video capture device 104 may be front facing in the sense that it has a camera 106 and display screen 108 facing in substantially a same direction as a user 110 to allow the user 110 to capture video of his anatomy while simultaneously being able to view in real time what is being recorded on the display screen 108 of the video capture device 104. As an example, the user 110 may hold a mobile phone in front of his head to capture a video of his head while also seeing the video captured on the display screen 108 to confirm in real time that the head is being captured. As another example, the user 110 may rotate his head while holding the video capture device stationary to capture a video of his pinna while using his periphery vision to confirm in real time on the display screen 108 that the pinna is being captured.

The HRTF personalization system 130 may include one or more of an image selection system 112, a feature detection system 114, a feature fusion system 116, a context aware image reconstruction system 118, and an HRTF prediction system 120 communicatively coupled together via a wireless and/or wired communication network (not shown). One or more of the image selection system 112, feature detection system 114, feature fusion system 116, context aware image reconstruction system 118, and HRTF prediction system 120 may be integrated together on a single platform such as the "cloud", implemented on dedicated processing units, or implemented in a distributed fashion, among other variations.

The image selection system 112 may analyze images of the captured video for those images containing features of importance and/or meeting various metrics such as contrast, clarity, sharpness etc. The feature detection system 114 may analyze the images with various image processing techniques to determine those features which impact HRTF prediction, including but not limited to an anatomy of a user, demographics of the user, accessories worn by the user, a 3D representation of the user, and/or any latent feature of the user. In some cases, the feature detection system 114 may detect an occlusion in an image that covers an anatomy of the user such as an accessory that the user is wearing. The feature detection system 114 may cause the context aware image reconstruction system 118 to post-process the image to yield an image showing only the occlusion and/or the anatomy without the occlusion to facilitate determining those features which impact HRTF prediction. These features are provided to the feature fusion system 116 which combines the different features determined by the feature detection system 114 to facilitate determining the HRTF of the user. The HRTF prediction system 120 may find a best matching HRTF for the determined features. The HRTF prediction system 120 may operate in different ways including classification-based which involves finding an HRTF in a measured or synthesized dataset of HRTFs which best spatializes sound for the determined features of the user. The different features may reduce the search space during prediction, or in general reduce the error associated with the predicted HRTF. Additionally, or alternatively, the HRTF prediction system 120 may also be regression-based that learns a non-linear relationship between the determined features and an HRTF, and uses the learned relationship to infer the HRTF based on the detected features. The personalized HRTF may be used to spatialize sound for the user by applying the personalized HRTF to sound output to a personal audio delivery device 150 such as headphones, hearable, headsets, hearing aids, earbuds or speakers to generate audio cues so that the user perceives the sound being spatialized in a certain location. An earcup of a headphone may be placed on the pinna and a transducer in the earcup may output sound into an ear canal of the human auditory system. As another example, an earbud, behind-the-ear hearing aid, or in-ear hearing aid may output sound into an ear canal of the human auditory system. Other examples are also possible.

Various methods and other processes are described which are associated with the image selection system, a feature detection system, feature fusion system, context aware image reconstruction system, and HRTF prediction system to spatialize sound. The methods and the other process disclosed herein may include one or more operations, functions, or actions. Although the methods and other processes are illustrated in sequential order, they may also be performed in parallel, and/or in a different order than those described herein. Also, the methods and other processes may be combined, divided, and/or removed based upon the desired implementation.

In addition, for the methods and other processes disclosed herein, flowcharts may show functionality and operation of one possible implementation of present embodiments. In this regard, each block of a flow chart may represent a module, a segment, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, each block in the figures may represent circuitry that is wired to perform the specific logical functions in the process.

Figure 2:
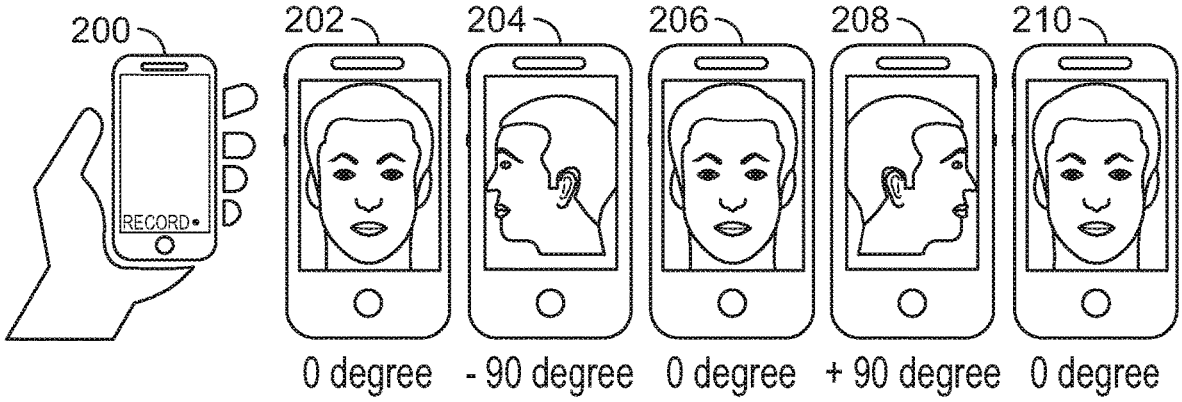
FIG. 2 illustrates an example video capture by a front facing video capture device.

FIG. 2 illustrates processing associated with the image capture system for capturing video by the front facing video capture device. The video capture device 200 may be a mobile phone and the video may be composed of a plurality of images 202-210, where the images are snapshots of the user. The user may fluidly move in front of the video capture device 200 and a camera of the video capture device 200 may capture the resulting movement. The video capture device 200 facilitates self-capture by providing visual feedback of the video being captured by the camera on a display screen of the video capture device 200. This visual feedback allows the user to accurately capture the features of the human anatomy associated with determining the personalized HRTF.

At 202, the video captured by the video capture device 200 may begin with capturing the head of the user. The user may hold the video capture device 200 in front of his head. Visual feedback allows user to see whether or not the camera is capturing his entire head and head only. The video captured at this position may be referred to as a user front orientation or 0-degree orientation.

At 204, the video captured by the video capture device 200 continues with capturing the ear of the user. The user may hold the video capture device 200 stationary while turning his/her head all the way to the left i.e. −90-degree; thus exposing his/her entire right ear to the video capture device that is recording the video.

At 206, the video captured by the video capture device 200 then shows the head of the user again. The user may still hold the video capture device 200 in its original orientation and keeping the video recording on, turns his/her head back to the front orientation (0-degree orientation).

At 208, the video captured by the video capture device 200 continues with capturing the other ear of the user. The user now turns his/her head all the way to the right i.e. +90-degree; thus exposing his/her entire left ear to the video capture device. All this time, video capture device 200 may stay in its original orientation while the video recording is in progress.

At 210, video captured by the video capture device 200 ends with the user turning his/her head back to the front orientation at which point the video recording may stop.

The video captured by the video capture device 200 may take other forms as well. For example, the order of steps performed by the user to generate the video may not necessarily need to be followed as described. The user can first turn his head all-the-way to the right (+90-degree), then to the front (0-degree) and finally all-the-way to the left (−90-degree) rather than all-the-way to the left (−90-degree), then to the front (0-degree) and finally all-the-way to the right (+90-degree) while continuing to record the video. As another example, the user may perform a subset of motions. A front head orientation and −90-degree orientation i.e. when user's head is all-the-way to the left and his/her right ear is fully exposed to the camera may be captured rather than both ears. Alternatively, a front head orientation and +90-degree orientation i.e., when user's head is all-the-way to the right and his/her left ear is fully exposed to the camera may be captured rather than both ears. As yet another example, capture of the head at 0-degree orientation may not be required. Other variations are also possible.

The user may provide input to start and/or stop the video capture process via any modality. For example, the user may provide a voice command to cause it to start and/or stop the video capture process. As another example, the user may gesture in front of the video capture device to cause it to start and/or stop the video capture process. As yet another example, the user may press a button on the video capture device to cause it to start and/or stop the video capture process. As another example, the video capture process may be started and stopped automatically by the video capture device when a complete set of images required for personalized HRTF prediction are detected. The image selection system and/or the feature detection system in communication with the video capture device may recognize one or more of a user's head, nose, ears, eyes, pupils, lips, head, body, torso, etc. and determine whether sufficient video is captured to perform the HRTF prediction and then signal the video capture device to stop the video capture. In this case, the video capture process could occur in a completely unconstrained manner, i.e., the process will not impose any restrictions on the relative motion of the video capture device with respect to the user (e.g., the video capture device may be moved and head remaining still during the video capture or both the video capture device and the head moved during the video capture) and the video capture process may stop when the sufficient video is captured to perform personalized HRTF prediction, e.g., one or more of the images 202-210. The video capture device may provide one or more of the images 202-210 to the image selection system.

Figure 3:
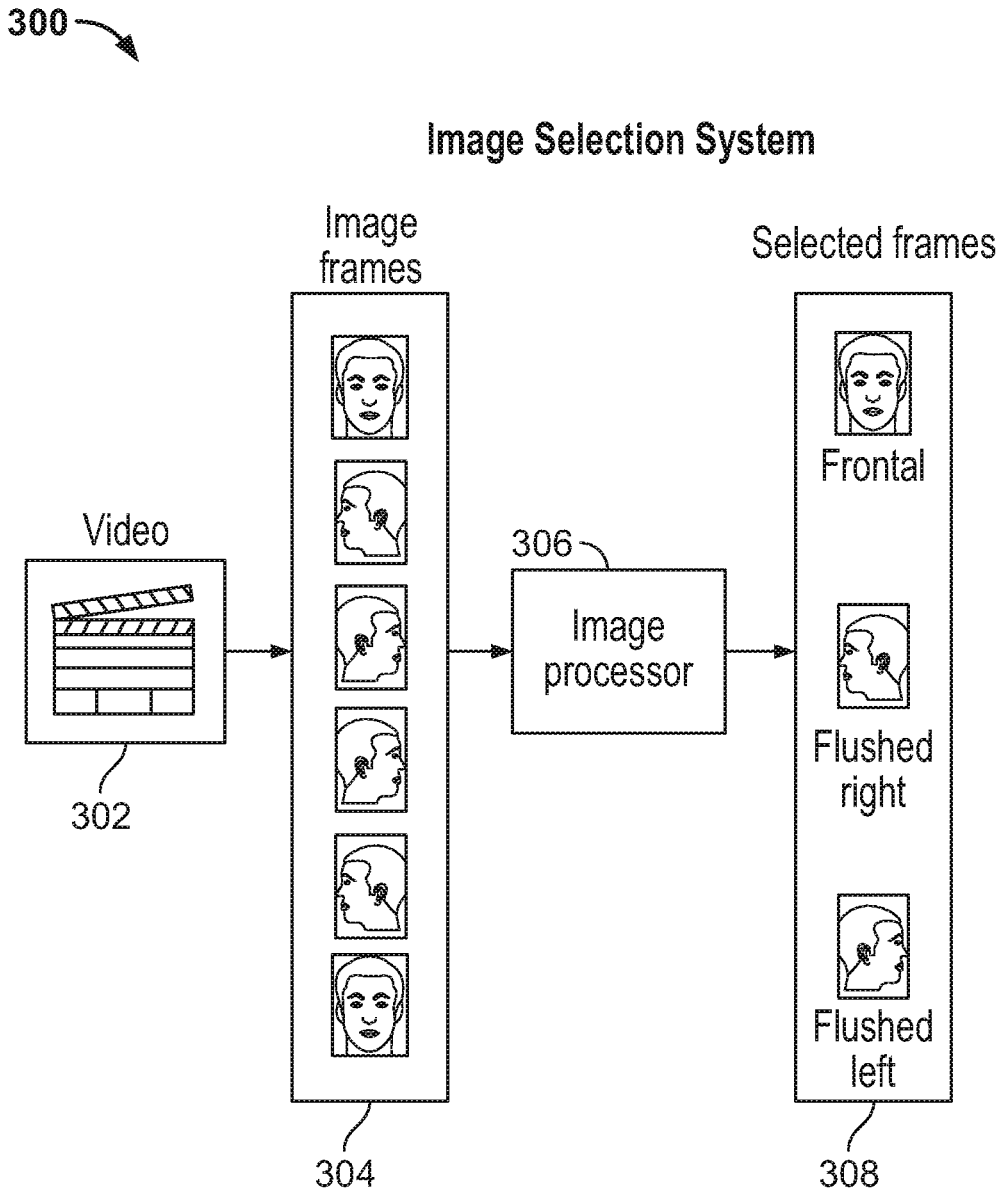
FIG. 3 shows functionality associated with an image selection system.

FIG. 3 shows functionality associated with the image selection system 300. The image selection system 300 may receive as input a video sequence 302 which comprises a plurality of images 304, i.e., 2D representations of the user, captured by the video capture device. The image selection system may have an image processor 306 which selects images 308 containing features of importance and/or meeting various metrics such as contrast, clarity, sharpness etc. The features of importance and/or metrics may be generally those features of highest importance in predicting HRTF. The images 308 may be the highest quality images of the user at 0 degree, +90 degree, −90 degree orientations and/or orientations which show the pinna and head of the user. The quality of the image may be adjudged on metrics such as contrast, clarity, sharpness etc. and may have a certain acceptable threshold. In case such images may not be available or acceptable, images at intermediate orientations between −90 degrees and +90 degrees, and/or images that yield features at a next level of feature importance in predicting HRTFs may be selected. The images 308 may be provided to the feature detection system.

Figure 4:
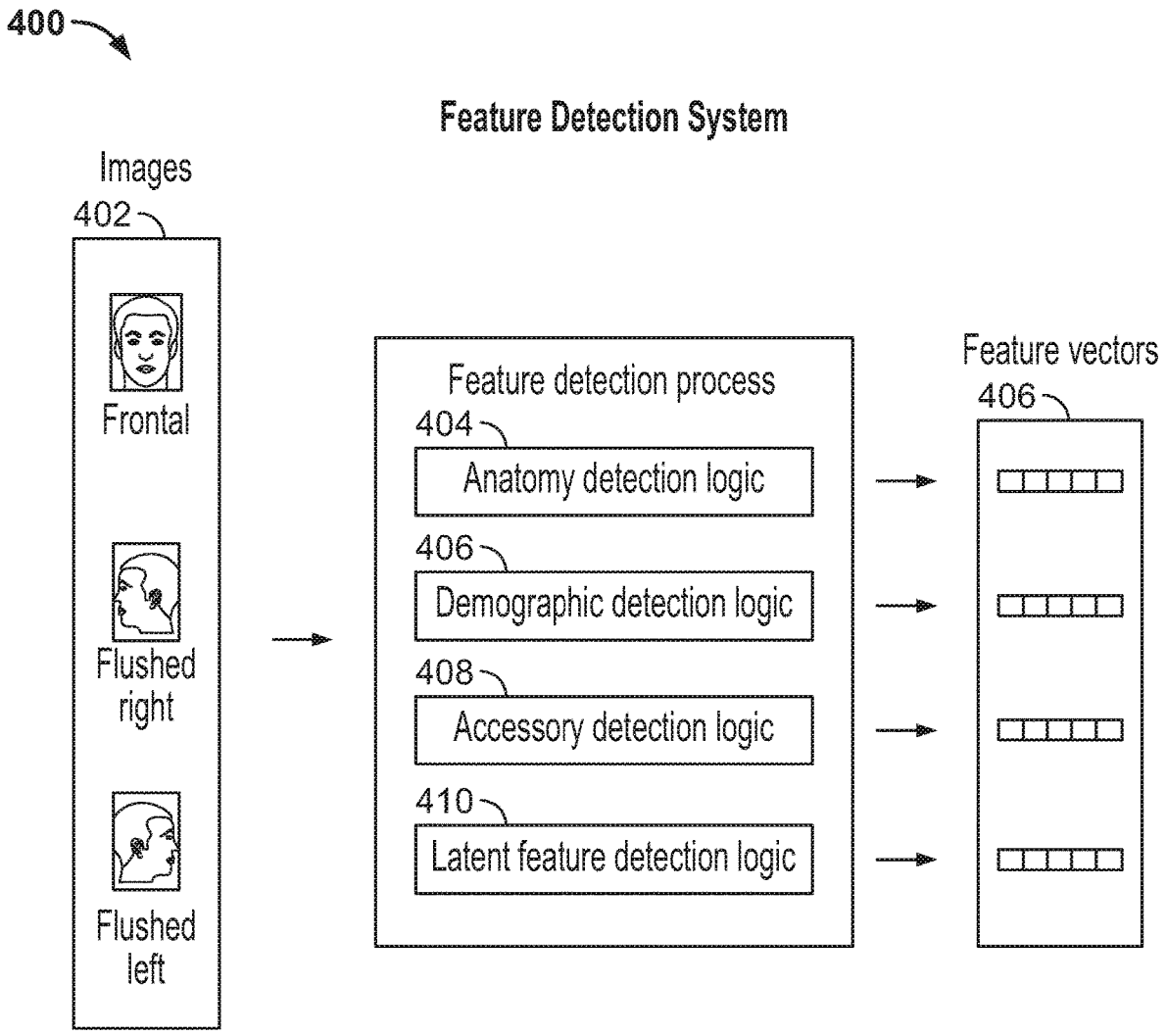
FIG. 4 shows functionality associated with a feature detection system associated with images provided by the image selection system.

FIG. 4 show functionality associated with the feature detection system 400. The feature detection system 400 may detect features in images 402 received from the image selection system relevant to personalizing the HRTF. In this way, the user does not have to manually provide any specific information about his features himself or herself Instead, the features are automatically determined only via the images 402 in some cases.

In one example, an anatomy of user may influence a user's auditory response. Based on image processing techniques, anatomy detection logic 404 may analyze the images 402 and determine a size and/or shape of the anatomy of the user which impacts HRTF personalization. The images 402 are two dimensional representations of the anatomy of the user. In some cases, the anatomy detection logic 404 may also generate a 3D representation of the user based on the images 402 and analyze the anatomy of the user based on the 3D representation. The anatomy detection logic 404 may output a feature vector 406 indicative of the anatomy such as its size and/or shape.

In another example, the HRTF may be based on demographics of the user. The demographic information may further influence a user's auditory response. For example, users with a same demographic may have a similar anatomy that results in sound being similarly spatialized. Based on image processing techniques, demographic detection logic 406 may analyze the images 402 and automatically determine demographic of the user including one or more of an individual's race, age and gender which impacts HRTF personalization. In some cases, the demographics logic 406 may generate a 3D representation of the user based on the images 402 and analyze the demographics of the user based on the 3D representation. The demographic detection logic 406 may output a feature vector 406 indicative of the demographic.

In yet another example, the HRTF may be based on accessories worn by the user or associated with the user and/or the images of the user without an accessory. Based on image processing techniques and the images 402, the accessory detection logic 408 may analyze the images 402 and automatically determine images of the accessories worn by the user which impacts HRTF personalization and/or images of the user without the accessory being worn. In some cases, the accessory detection logic 408 may generate a 2D and/or 3D representation of the accessories worn by the user which impacts HRTF personalization and/or a 2D and/or 3D representation of the user without the accessory being worn. The accessory detection logic 408 may output a feature vector 406 indicative of the accessory.

In another example, the feature detection system may have latent feature detection logic 410. A face has observable features such as chin shape, skin color, ear shape. A latent feature in the images captured by the video capture system impacts sound spatialization, but may not represent a particular tangible or physical feature of the user such as chin shape, skin color, eye color, ear shape etc. Instead, the latent feature may be an aggregation of the observed features such as the eye and ear of the user or differences between the two eyes of the user. The latent feature representation logic 410 may have a neural network that generates a plurality of latent features. The latent feature representation logic 410 may output a feature vector 406 indicative of the latent features.

Figure 5:
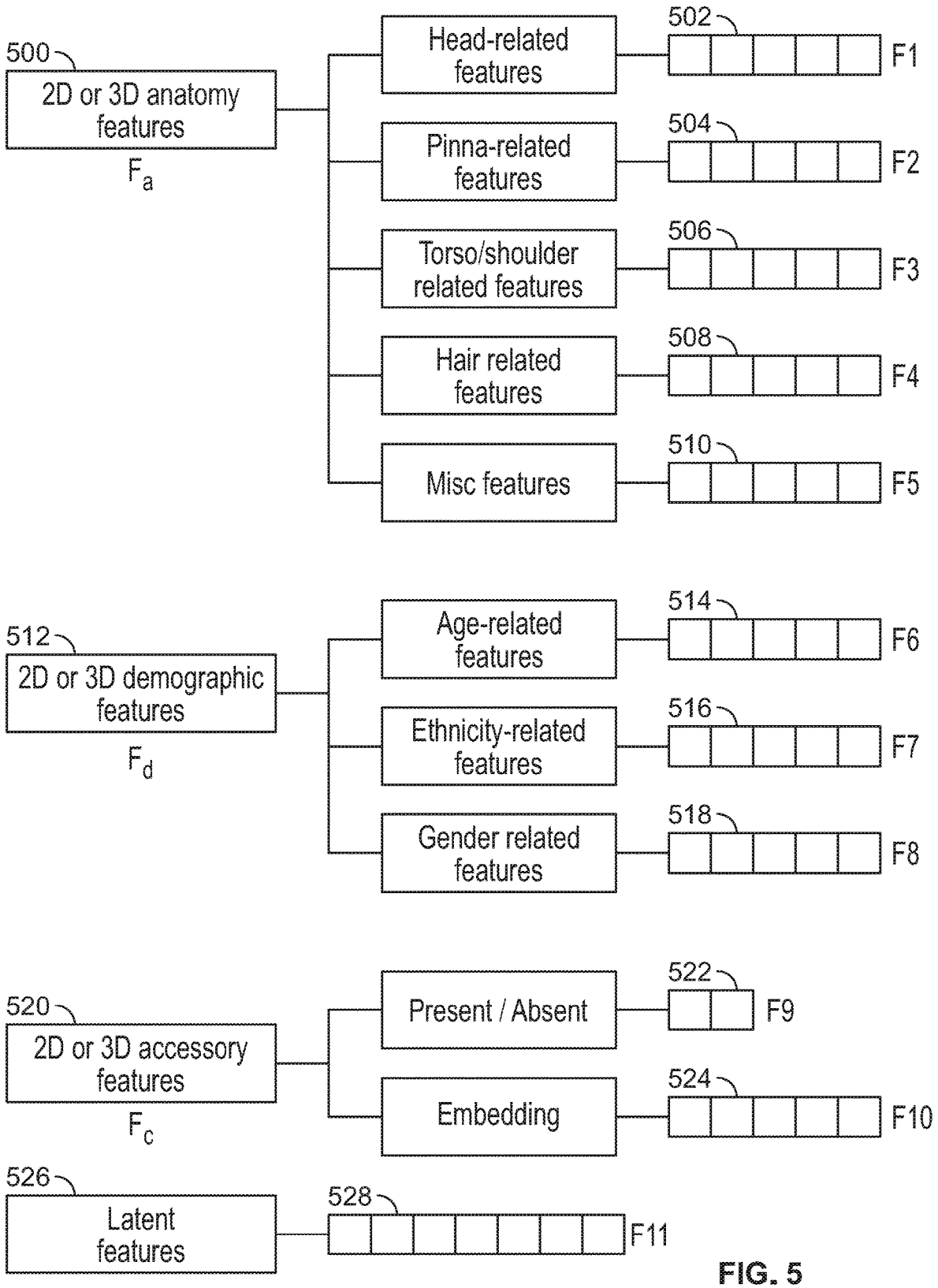
FIG. 5 illustrates example features determined by the image selection system.

FIG. 5 illustrates example features detected by each of the logic associated with the feature detection system. The features can be categorized as 2D or 3D anatomy features 500, 2D or 3D demographic features 512, 2D or 3D accessory features 520, or latent features 526 among other examples.

The 2D or 3D anatomy features 500 (referenced as $F_a$) may include head related features such as the shape and/or size of the head (for example, head height, width and depth) and landmarks of the head, neck width, height and depth stored in a feature vector 502. The feature vector may be a storage medium such as memory for storing an indication of certain features. The anatomy features 500 may further include the pinna related features such as a shape, depth, curvature, internal dimensions, landmarks, location and offset of the ear, and structure of the ear cavities such as cavum height, cymba height, cavum width, fossa height, pinna height, pinna rotation angle, and pinna width, among other features stored in a feature vector 504. The anatomy features 500 may include torso/shoulder related features such as torso shape and/or size, shoulder shape and/or size stored in a feature vector 506. The anatomy features 500 may further include hair related features such as hair style, texture, color and volume stored in a feature vector 508. The anatomy features 500 may also include miscellaneous features such as distances and/or ratios of distances between any one or more of the human body parts/landmarks, the position of the body parts relative to each other and/or the weight of a user stored in a feature vector 510. The miscellaneous features may also describe the features in reference to geometric local and/or holistic descriptors such local binary pattern (LBP), Gabor filters, binaries statistical image features (BSIF), Wavelet etc.

The demographics features 512 (referenced as $F_d$) may include one or more indications of a user's age, for example 22 years old, stored in a feature vector 514. The demographics features 512 may also include indications of a user's ethnicity for example Asian, Caucasian, European, etc. stored in a feature vector 516. The demographics features 512 may include an indication of a user's gender such as male or female stored in a feature vector 518.

The 2D or 3D accessories features 520 (referenced as $F_c$) may indicate whether an accessory is present or absent on an anatomy and stored in a feature vector 522. The feature vector 522 may store a binary indication of the presence or absence of the accessory. Accessories may include earrings, hairstyle, body ink and piercings, type of clothing etc. The 2D or 3D accessories features 520 may be represented by a sequence of numbers or some other representation using image or 3D model embedding. The sequence of numbers or other representation may be stored in a feature vector 524.

The latent features 526 may indicate a feature which is not a physical or tangible feature of the user, but which impacts sound spatialization. As described in further detail below, the latent features may be learned from the images and represented as a sequence of numbers or some other representation ($F_1$) stored in a feature vector 528.

Figure 6:
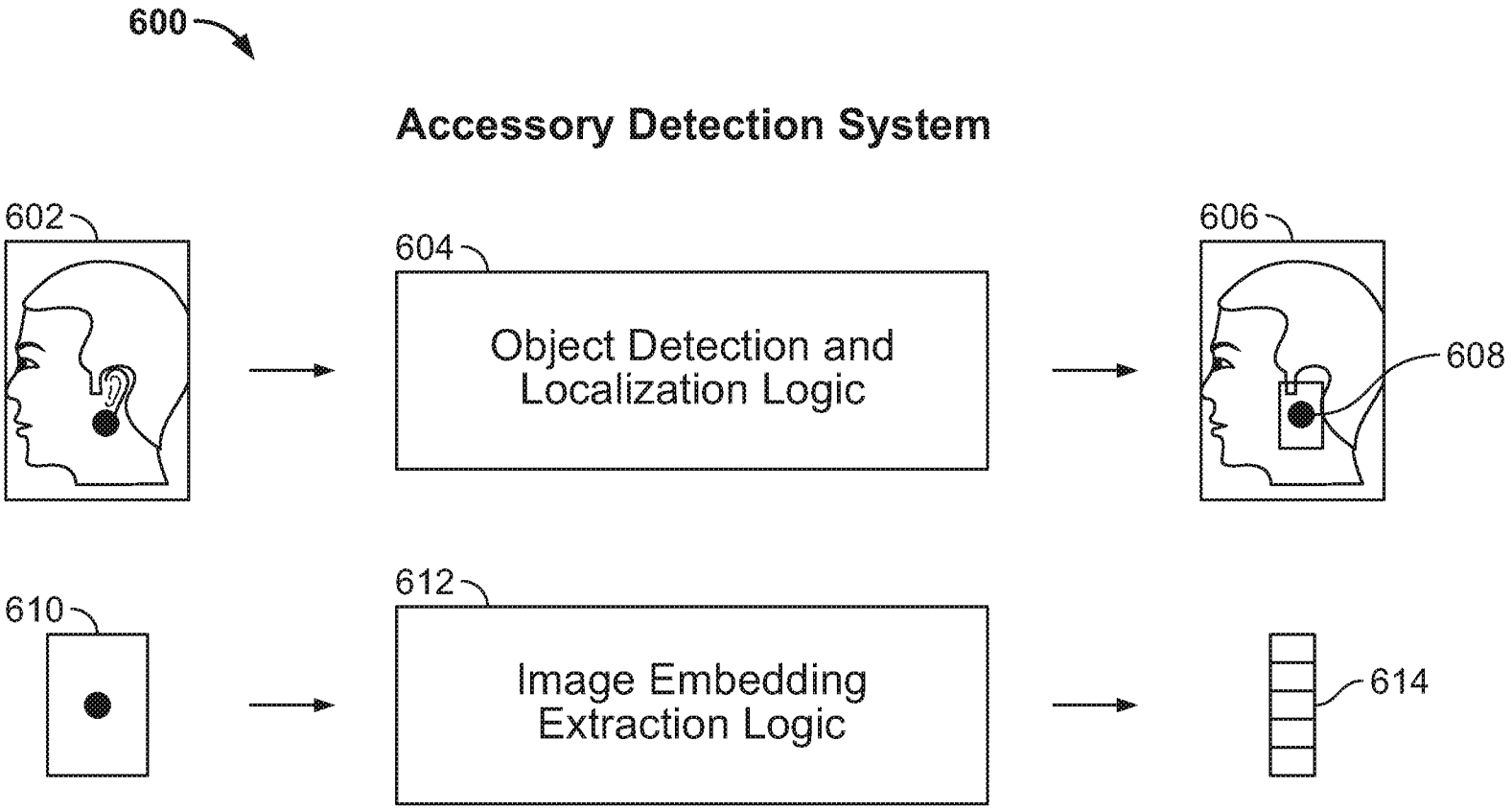
FIG. 6 shows functionality associated with an accessory detection system for determining accessory features.

FIG. 6 shows functionality associated with an example accessory detection system 600 for determining accessory features in accordance with the accessory detection logic. An image 602 of a user with accessory in the form of an earring is input into object detection and localization logic 604. The logic 604 may perform object detection to identify if an accessory is present based in the image 602 and localize the accessory. An output 606 of the logic 604 may indicate the presence and/or location of the accessory by localizing the accessory with a bounding box 608. The logic 604 may use convolution neural network (CNN) techniques such as region proposal based CNNs or single shot detectors to detect the accessory. The region proposal based CNNs may include techniques such as regions+convolution neural nets, fast region+convolution neural nets, faster region+convolution neural nets. In general, the region based CNN models rely on generating a set of region proposals for bounding boxes through selective search. These image proposals are passed through a classifier to infer their label, for example an image proposal may be classified as containing an accessory. Once the label has been identified, the bounding box is run through a linear regression model to output tighter coordinates for the accessory. A single shot detector may include techniques such as you only look once (YOLO) and multi box single shot detectors (SSD). Unlike region based CNNs, single shot detectors do not generate region proposals. These detectors predict the occurrence of an object on a fixed set of boxes with varying scales and aspect ratios. Instead of the bounding box 608, the logic 604 may return a 2D image of the segmented accessory, where the contour of the accessory is well-defined. This segmented accessory 610, is fed as input to the image embedding extraction logic 612, which reduces the dimensionality of the image to a reduced representation, also referred to as image embedding. The image embedding extraction logic 612 may represent the accessory in terms of specific acoustic impedance and geometry determined from texture and shape defined by the segmented accessory 610 stored in a feature vector 614. Extracting acoustic properties of the accessory facilitate determining the HRTF as described in more detail below.

Figure 7:
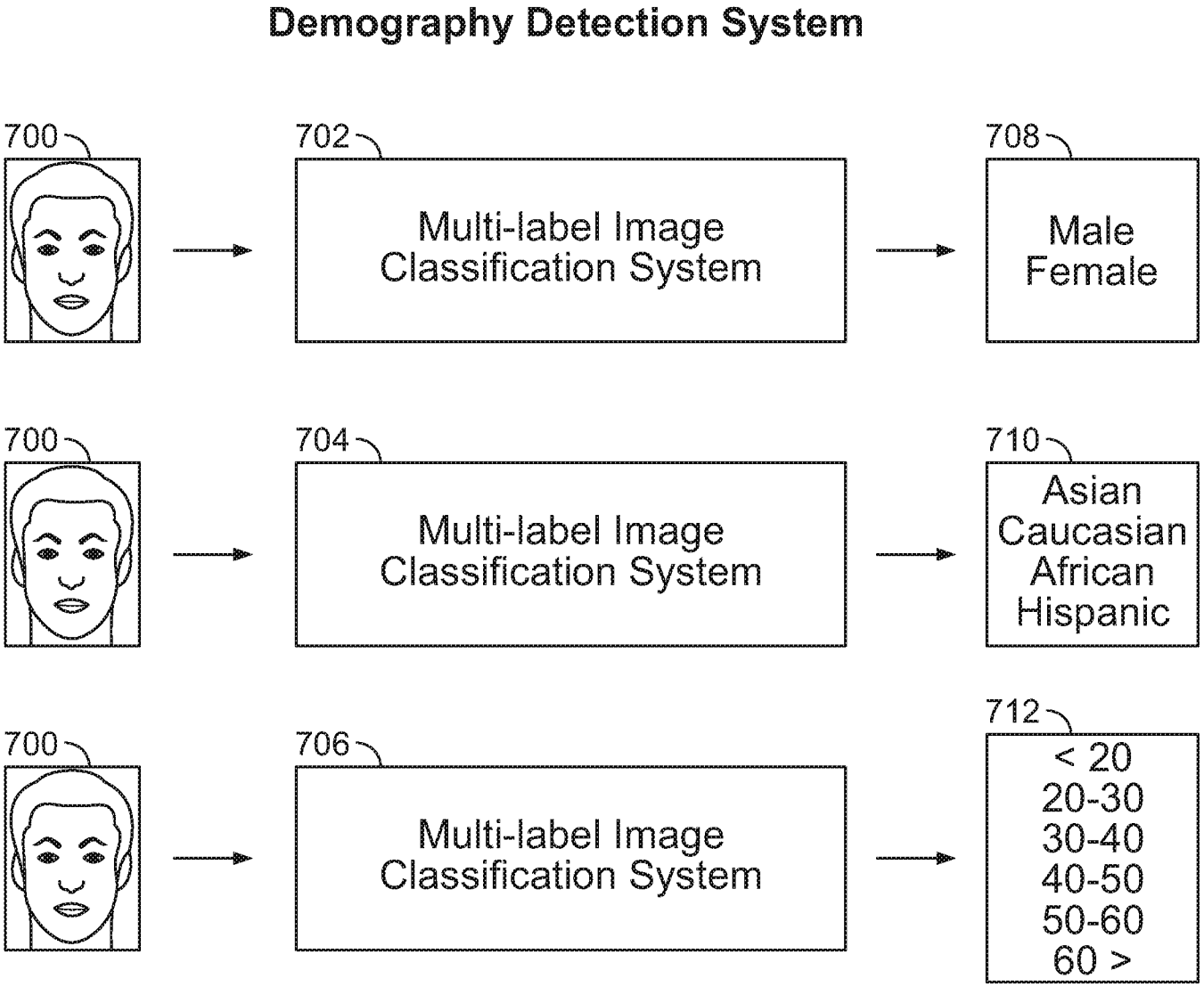
FIG. 7 shows functionality associated with a demographic detection system for determining demographic of the user.

FIG. 7 shows functionality associated with an example demographic detection system for determining demographic of the user from the images and/or 3D reconstruction in accordance with the demographic detection logic. An image of the user 700 may be fed as input to multi-label classification system 702, 704, 706. The multi-label classification system 702, 704, 706 may be trained to output various demographics associated with the user, including gender labels 708, ethnicity labels 710, and/or age group labels 712 based on a classification of the image of the user 700 with a data set of images indicative of a given gender, ethnicity, and/or age group. The gender labels 708 may be one-hot encoded and indicate gender such as male or female and stored in the feature vector. Similarly, the ethnicity labels 710 may be one-hot encoded and indicate user ethnicity for example, Asian, Caucasian, African, Hispanic and stored in the feature vector. The age labels 712 may be one-hot encoded and indicate the age-group of the user such as less than 20 years, 20-30 years, 30-40 years, 40-50 years, 50-60 years and 60 years plus and stored in the feature vector. The age of the user may be further inferred from an image regression model, where instead of obtaining a prediction based on a classification, a direct prediction of the age is made.

Figure 8:
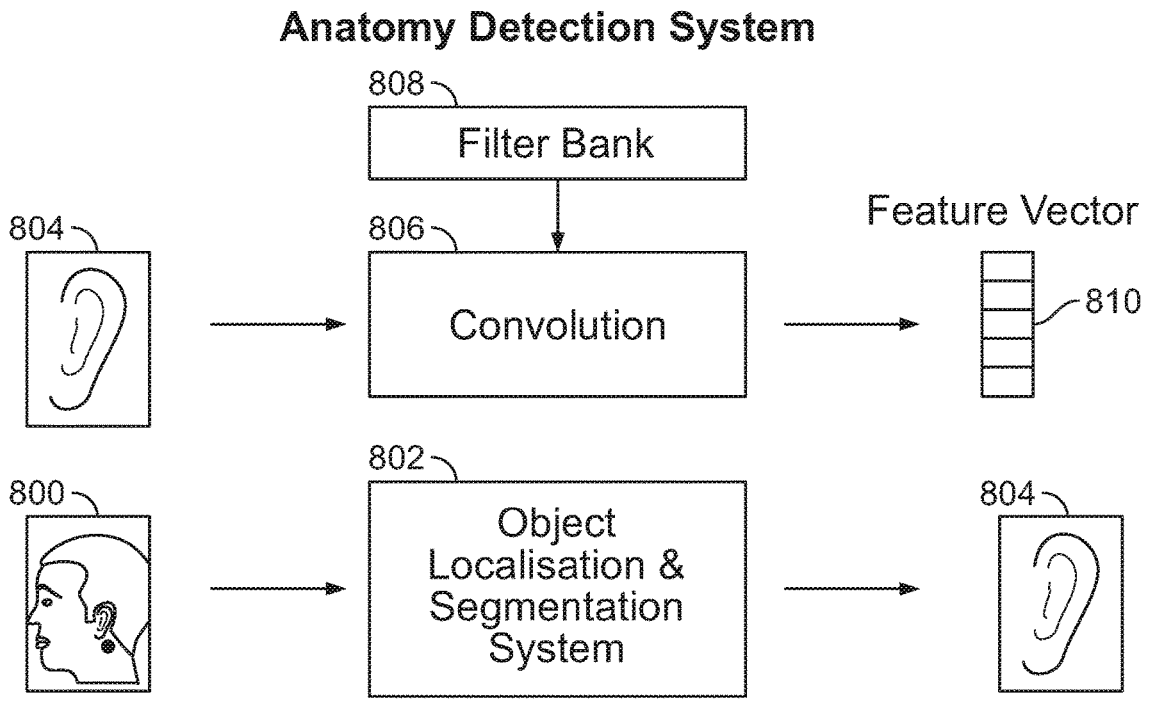
FIG. 8 shows functionality associated with an anatomy detection system for detection of features related to the anatomy of the user.

FIG. 8 shows functionality associated with an example anatomy detection system for detection of features related to the anatomy of the human head, ear, torso, shoulder etc. in accordance with the anatomy detection logic. An image of the user 800 may be input into an object localization and segmentation system 802 which then provides as an output 804 an image of localized anatomical components such as the pinna. This process may be followed by one or more shape and/or texture extraction method for edges, corners, contours, landmarks etc. associated with the localized anatomical components. The anatomical components may be described in terms of geometric, local, holistic and hybrid descriptors such as Gabor, Wavelet, BSIF, LBP etc. by convolving 806 (e.g., a sliding window convolution) the output 804 with one or more filters in set of filter banks 808 to output features of the anatomy to a feature vector 810. The filter banks 806 may be hand-crafted and/or learnt through training of neural networks.

Figure 9:
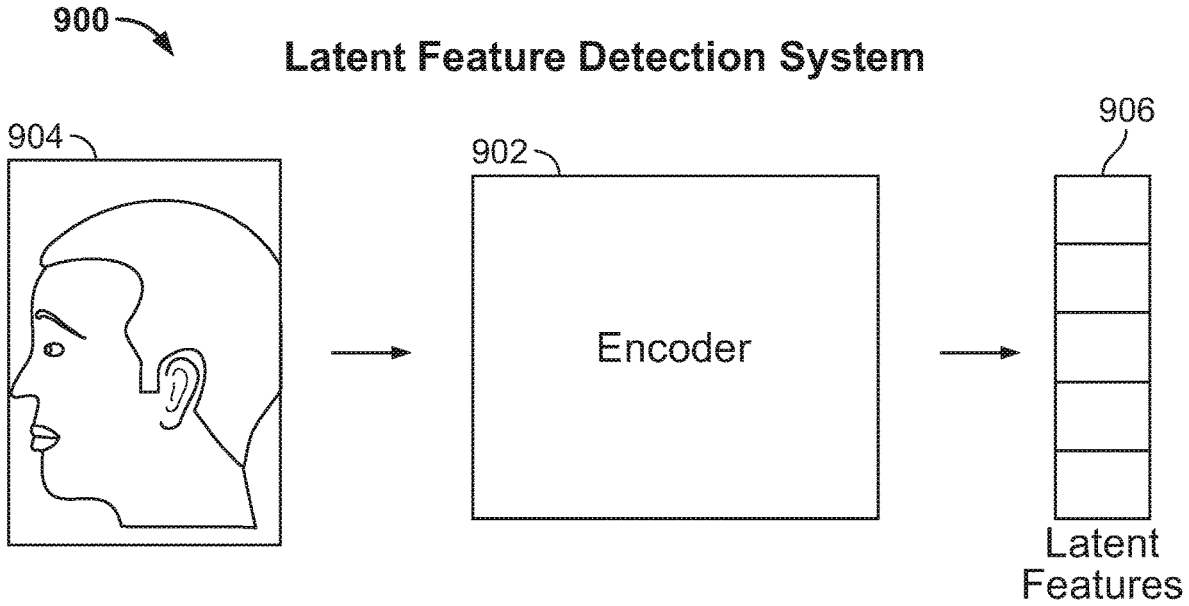
FIG. 9 shows functionality associated with a latent feature detection system for detection of latent features.

FIG. 9 shows functionality associated with a latent feature detection system 900 for detection of latent features in the one or more images relevant to HRTF prediction in accordance with the latent feature detection logic. The latent feature detection system 900 may have an encoder 902 for determining latent features in the one or more images 904 and outputting the latent features 906 relevant to HRTF prediction. The encoder may use a neural network or some other numerical analysis to identify and output those latent features 906 relevant to the HRTF prediction. The encoder 902 operates by receiving one or more images 904 input into the encoder 902 which reduces a dimensionality of the one or more images 904 to latent features 906 relevant to the HRTF prediction. In particular, the encoder 902 may distinguish those latent features relevant and not relevant to HRTF prediction and output the latent features 906 relevant to HRTF prediction.

Figure 10:
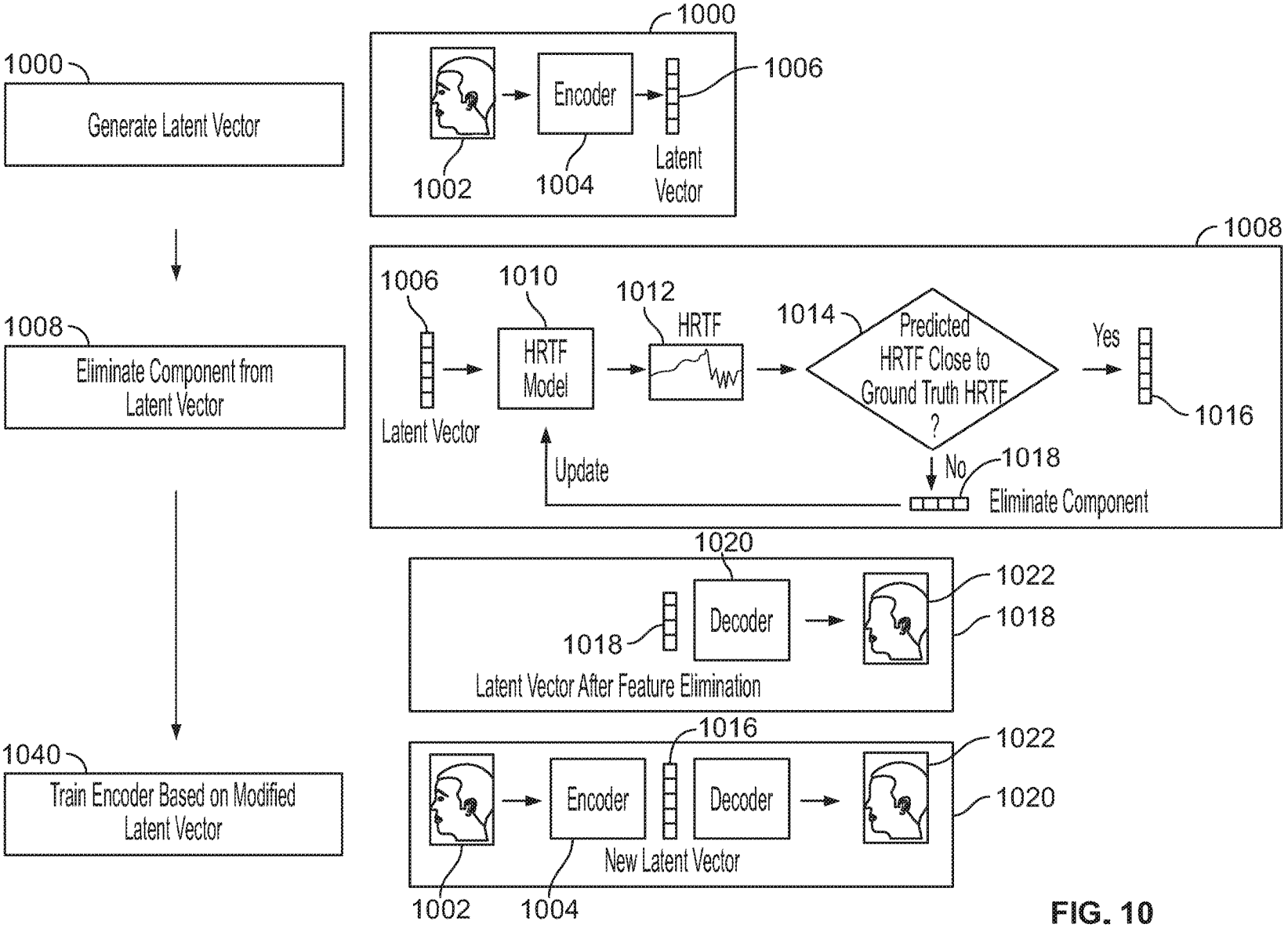
FIG. 10 illustrates a training process for an encoder which output the latent features.

FIG. 10 illustrates a training process for the encoder which output the latent features relevant to HRTF prediction based on the one or more images.

At 1000, a latent vector (e.g., composed of latent features) is generated. One or more images 1002 associated with a test subject are input into an encoder 1004 which is to be trained. The test subject may be a person other than the user and the encoder 1004 may output a feature vector in the form of a latent vector 1006. The latent vector 1006 may have multiple components indicative of the latent features associated with the one or more images 1002.

Initially, the encoder 1004 may generate a latent vector 1006 sufficient to reconstruct the one or more images 1002 from the latent vector 1006 via a decoder process. Certain components of the latent vector 1006 may not be relevant to predicting the HRTF. At 1008, the latent vector may be modified by a feature elimination process to remove those components not relevant to predicting the HRTF. The modification may be manual or automated, and involve inputting the latent vector 1006 into an HRTF model 1010 which outputs an HRTF 1012. The HRTF model 1010 may be trained to output the HRTF 1012 based on the latent vector 1006. The HRTF for the test subject may be known and referred to as a ground truth HRTF. The ground truth HRTF for the test subject may be the HRTF for the test subject measured, e.g., in an anechoic chamber via a microphone placed in a pinna of the test subject, or numerically simulated using a boundary or finite element methods in the cloud, on a dedicated compute resource with or without a graphics card, or in a distributed fashion. At 1014, a determination is made whether the HRTF 1012 and ground truth HRTF are similar. If the HRTF 1012 is perceptually and/or spectrally similar to the ground truth HRTF (e.g., a difference is less than a threshold amount), then the latent vector 1006 is not changed and a latent vector 1016 is output. Otherwise, a component in the latent vector 1006 is removed (since it is negatively affecting the HRTF determination) and a modified latent vector 1018 is input into the HRTF model 1010. This process is repeated by removing different components until the HRTF 1012 output by the HRTF model 1010 is acceptable at which point the latent vector 1016 is output.

In some cases, a determination of which component to remove from latent vector 1018 may be based on decoding the latent vector with a given component removed. This latent vector with the given component removed may be fed as input to a decoder 1020 which is arranged to reconstruct a new image 1022 based on the latent vector 1018 with the given component removed. Some features of the image may not be able to be decoded by the decoder 1020 since latent components were removed at 1008. If the features not decoded are not relevant to HRTF prediction, then the given component may be removed from the latent vector 1018 and provided to the HRTF model 1010. As an example, the new image 1022 shows that the eyes are not decoded. The eyes are also not relevant to HRTF prediction and so that component may be removed from the latent vector 1018. If the features not decoded are relevant to HRTF prediction, then the given component may not be removed from the latent vector 1018 and provided to the HRTF model 1010. In this regard, the decoder 1020 may facilitate determining which components to remove from the latent vector 1018.

At 1040, the encoder 1004 is trained on the image 1002 and new image 1022 to output the modified latent vector 1016 which when decoded by a decoder 1022 produces the new image 1022. In some cases, modified latent vector 1016 may be further modified such that the latent features in the modified latent vector 1016 are orthogonal. This training process for the encoder 1004 may continue for a plurality of the test subjects. Then, the encoder 1004, as trained, may be used to determine the latent vector for the user based on one or more images associated with the user in a manner similar to that described in FIG. 9.

In some example, the context aware frame reconstruction system may generate images for use by one or more of the anatomy detection system, accessory detection system, and/or latent feature system to facilitate feature detection. The images may differ from those captured by the video capture device.

Figure 11:
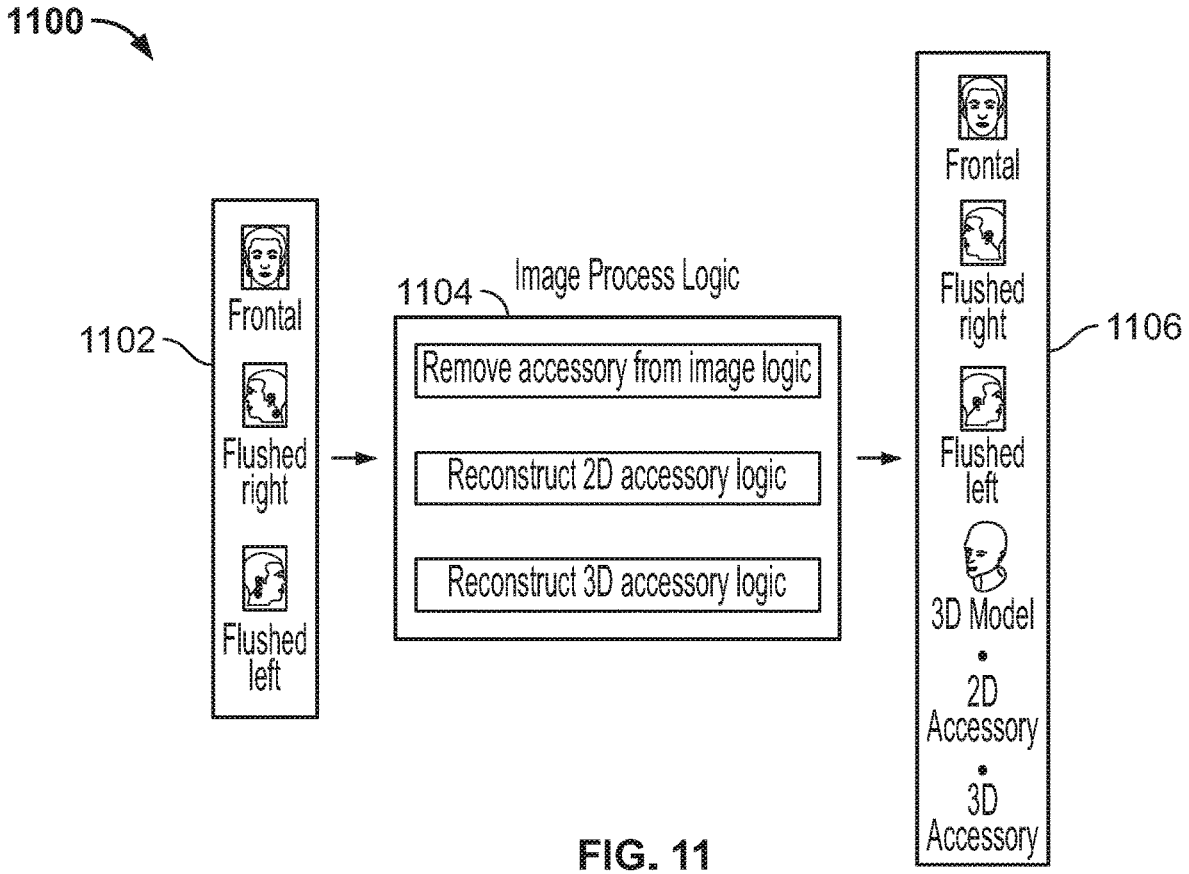
FIG. 11 shows functionality associated with the context aware frame reconstruction system.

FIG. 11 illustrates functionality associated with the context aware frame reconstruction system 1100. The context aware frame reconstruction system 1100 may determine appearance of anatomy of a user when occluded with an accessory or other object. One or more images 1102 where a subject is wearing an accessory may be input into image processing logic 1104 which decomposes the image 1102 into modified images 1106. The image processing logic 1104 may include logic to remove an accessory from an image and reconstruct the accessory in 2D form and/or 3D form. The image processing logic 1104 may provide the output 1106 which includes (a) a 2D or a 3D representation of the accessory, and (b) a 2D or a 3D representation of the subject's anatomy without occlusion by the accessory. Other functionality is also possible.

Figure 12:
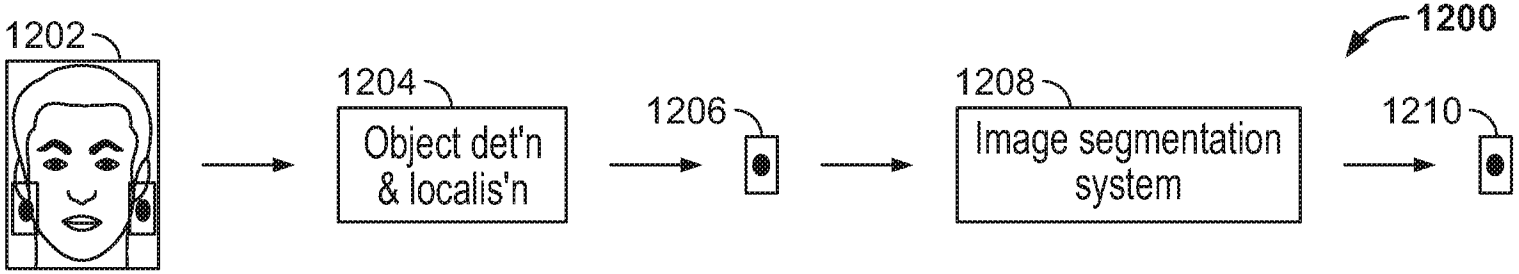
FIG. 12 shows functionality associated with extracting an accessory from an image.

FIG. 12 illustrates functionality 1200 associated with extracting an accessory from an image 1202 associated with a user. The image 1202 is input into an object detection and localization system 1204 which outputs a bounding box 1206 around the accessory. Then, an image in the bounding box 1206 may be input into an image segmentation system 1208 to isolate edges or the boundaries defining the accessory. Image segmentation techniques such as edge detection, region-based detection, clustering, watershed methods, convolution neural network may be used to extract the accessory from the subject's image which is provided as an output 1210.

Figure 13:
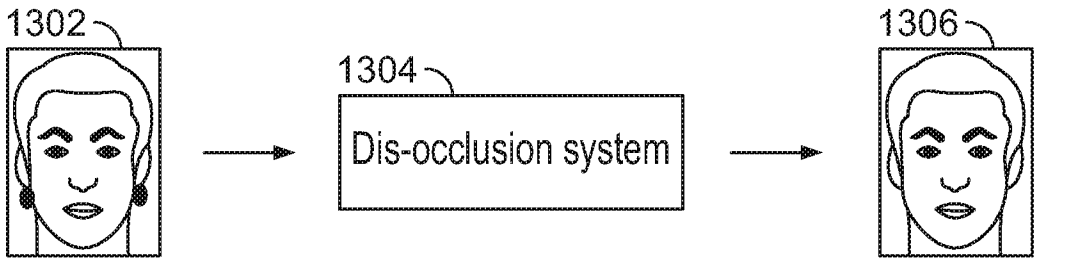
FIG. 13 shows functionality associated with constructing an image without the accessory.

FIG. 13 illustrates functionality 1300 associated with constructing an image without the accessory. For example, if a part of the ear is occluded by an earring and/or a user is wearing sun-blocking glasses, the ear lobe and the eyes may be reconstructed without the earring or sun-blocking glasses. An image 1302 containing the user wearing an accessory is input into disocclusion system 1304. The disocclusion system 1304 may remove the accessory from the image using a generative adversarial network trained to synthesize reconstructions that appear more like the human anatomy. A traditional image in-painting or hole filling approach may fill both the ears with pixels matching the color of the skin in 2D and/or pixels matching eyes. Additionally, or alternatively, the disocclusion system 1304 may generate a 3D reconstruction of the human anatomy of the user without the accessory. An image 1306 may be output which does not have the accessory and is used in the feature detection system.

The images captured by the video capture system may be equivalent to a 2D representation of the user and directly used to determine the features. In some cases, the features may be determined based on 3D representation of the user. The images may be used to synthesize the 3D representation of the user. Then, the 3D representation may be used to determine the features of the user relevant to HRTF prediction.

Figure 14:
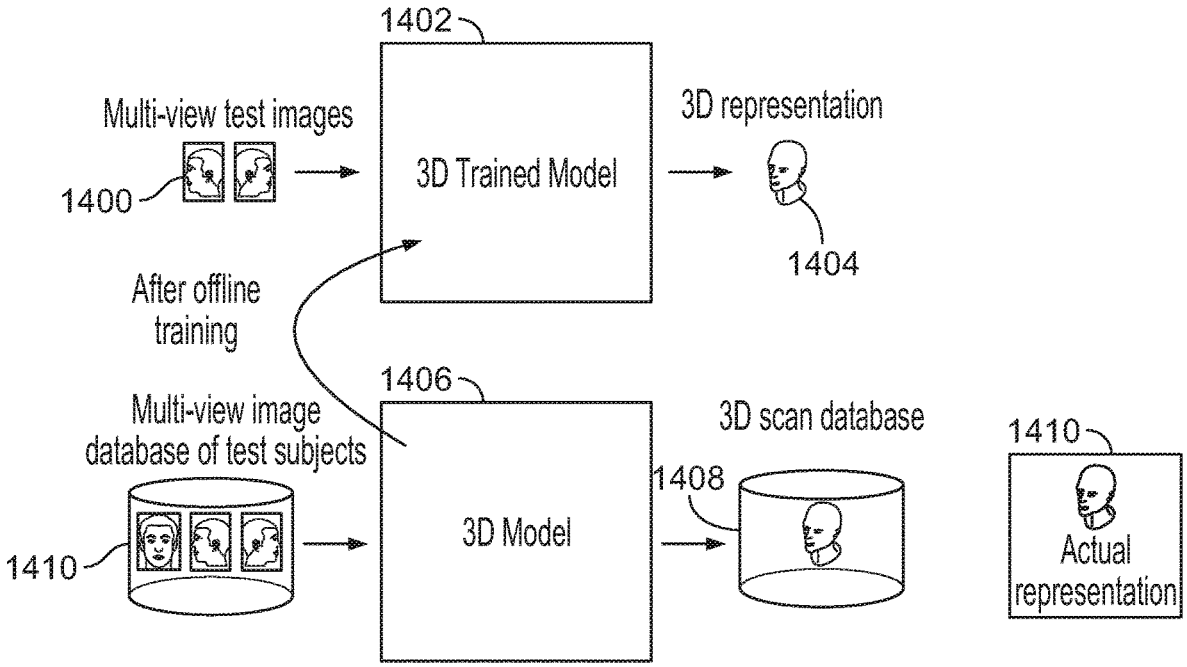
FIGS. 14 and 15 illustrate example machine learning techniques for synthesizing a 3D representation of an anatomy of a user.
Figure 15:
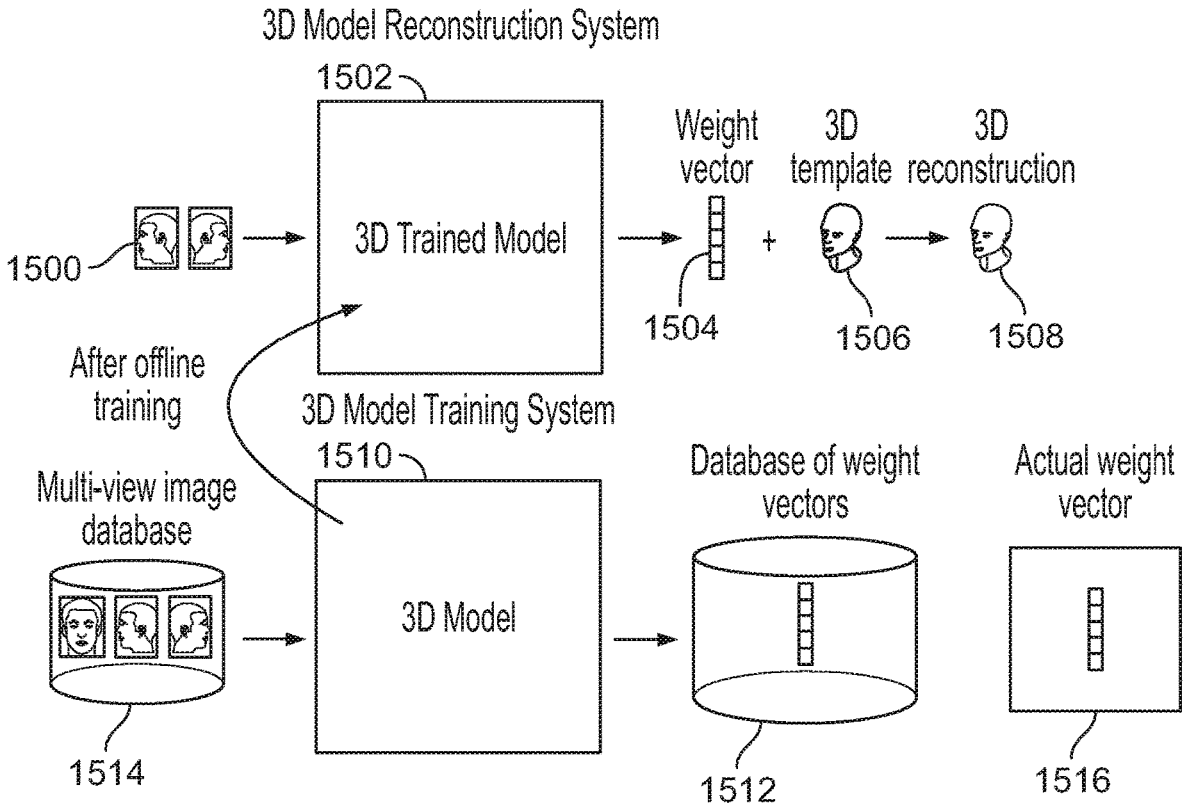

FIGS. 14 and 15 illustrate example machine learning techniques for synthesizing a 3D representation of an anatomy of a user from the images.

In FIG. 14, images 1400 output by the image selection system and/or context aware frame reconstruction system may include one or more views of the user such as at 0 degrees, 90 degrees, −90 degrees etc. The one or more images 1400 is input into a neural network taking the form of a 3D trained model 1402 which outputs a 3D representation 1404 of the user. The 3D trained model 1402 may be defined in a training process where 2D images 1410 associated with the test subjects is input into a 3D model 1406 which is fine tuned to generate 3D representations 1408 of various test subjects that match known actual 3D representations 1410 of the test subjects. On convergence of an objective function associated with 3D model 1406, the 3D model 1406 may be used to determine the 3D representation 1404 of the user.

In FIG. 15, images 1500 are input into a neural network taking the form of a 3D trained model 1502 which generates weight vectors 1504. The weight vector 1504 may be indicative of one or more of a size and shape of various human anatomy of the user. For example, the weight vector 1504 may have an entry indicative of a size of a pinna while another entry may be indicative of a size of a head. The weight vector 1504 may be applied to a generic 3D representation 1506 of a human to construct the 3D representation 1508 of the user. The generic 3D representation 1506 may represent various human anatomy of a human which can be sized based on the weight vector. The anatomy of the 3D generic representation 1506 may be adjusted by the weight vector 1504 to generate the 3D representation 1508 of the user. For example, a size of a pinna associated with the 3D generic representation may be adjusted to the entry of weight vector 1504 associated with the size of the pinna. As another example, a size of a head associated with the 3D generic representation may be adjusted to the entry of weight vector 1504 associated with the size of the head. In this regard, the 3D generic representation may be transformed to the 3D representation of the anatomy of the user.

The weights may be based on an objective function associated with the 3D trained model 1502. The objective function may be defined in a training process where 2D images 1514 associated with the test subjects is input into a 3D model 1510 which is fine tuned to output weight vectors 1512 of various test subjects that match known actual weight vectors 1516 of the test subjects. On convergence of the objective function associated with the 3D model 1510, 3D model 1510 may be used to determine the weight vectors 1514 for the user based on the images 1500 that allows for generating the 3D representation of the anatomy of the user.

Figure 16:
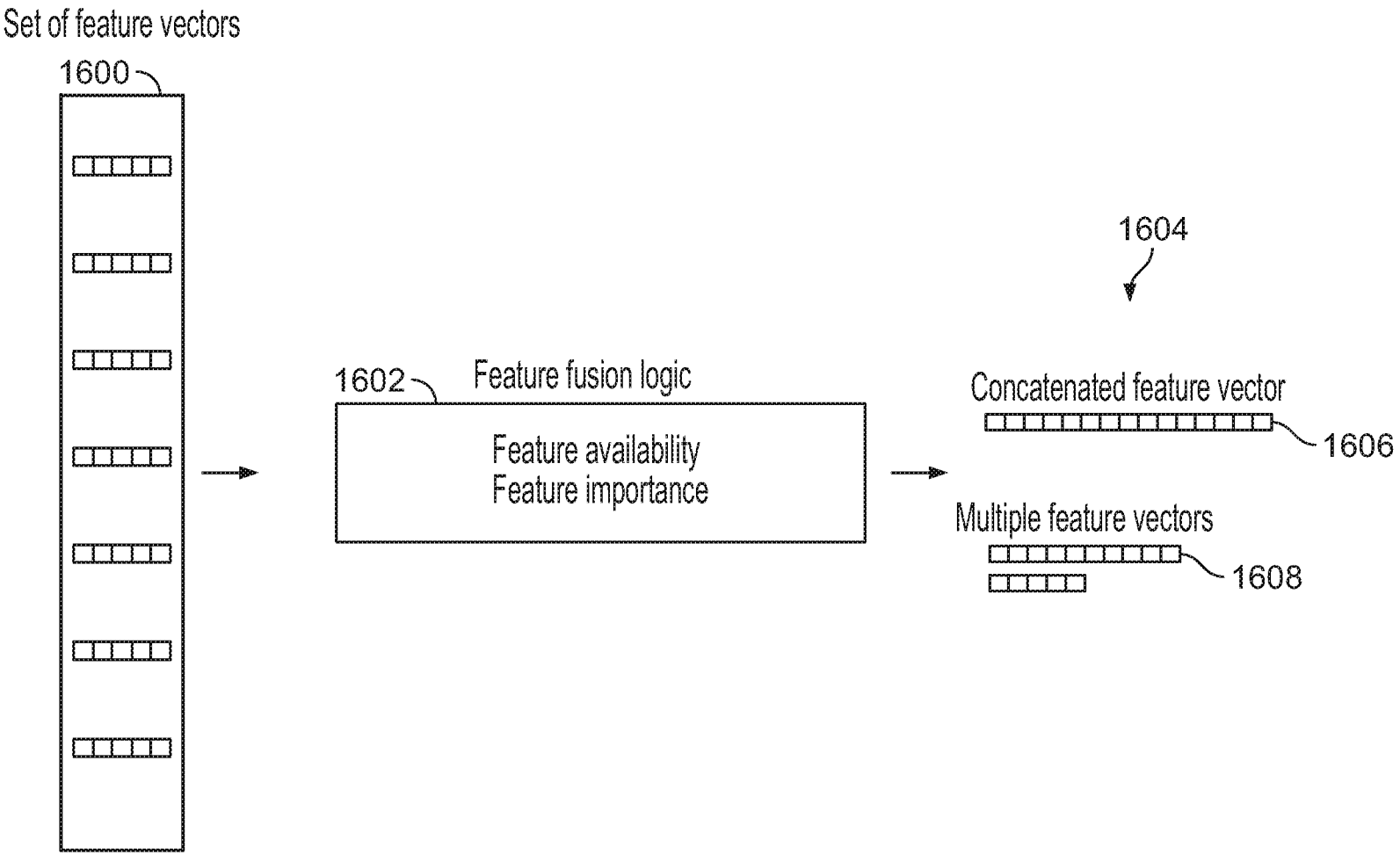
FIG. 16 shows functionality associated with a feature fusion system.

FIG. 16 illustrates functionality associated with the feature fusion system. The feature fusion system takes a set of features 1600, e.g., output by the accessory detection system, anatomy detection system, latent feature system, which is input into the feature fusion logic 1602 and depending upon an importance, quality, and/or availability of the features 1600 outputs a feature vector that will be used to predict the HRTF. The feature vector may be a concatenation 1604 of certain features in the set of feature vectors 1600 that is input into an HRTF model of the HRTF prediction system to personalize the HRTF for the user. For example, if the HRTF model receives as input head and torso features, the concatenation 1604 may include those features as a concatenated feature vector 1606. Alternatively, the concatenation 1604 may be a set of multiple concatenations of feature vectors 1608 where one concatenation of the set is used to identify an HRTF model and another concatenation of the set is input into the HRTF model to determine the personalized HRTF. For example, if the HRTF prediction system includes different HRTF models for different demographics, a concatenation of the set 1608 may include those features of the user to determine his demographic. The HRTF prediction system can then identify the appropriate HRTF model for the demographic. Then, another concatenation of the set 1608 may include head and torso features which is then input into the identified HRTF to determine the personalized HRTF. The feature fusion system may output other variations of the set of features 1600 as well.

Figure 17:
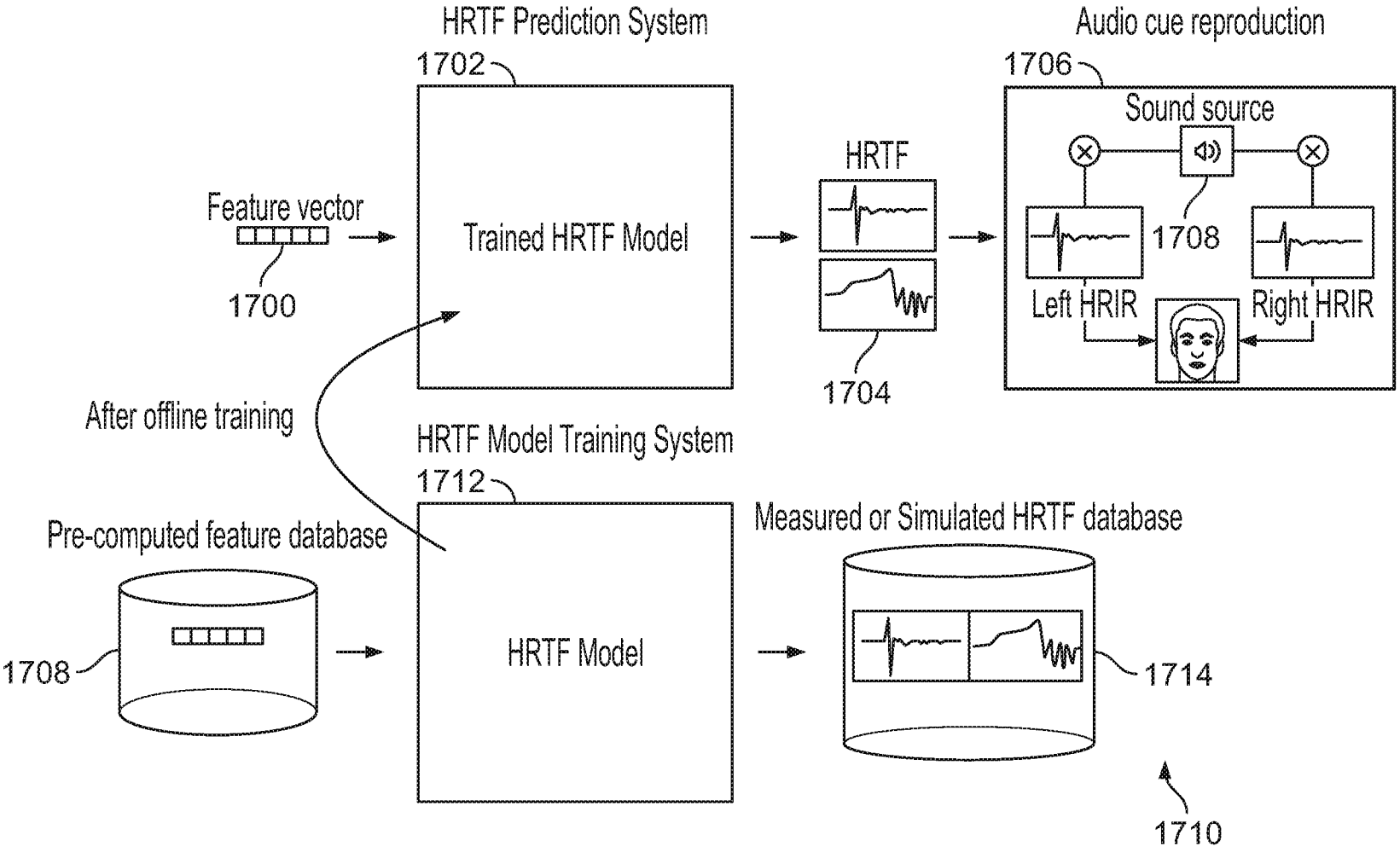
FIG. 17 shows functionality associated with the HRTF prediction system for determining the HRTF of the user.

FIG. 17 illustrates functionality associated with an HRTF prediction system to spatialize sound. A feature vector 1700 which includes features output by the feature fusion system may be input into the HRTF prediction system 1702. The HRTF prediction system 1702 may include one or more trained HRTF models. The trained HRTF models may be used to predict an HRTF 1704 for the user based on the feature vector 1700. In an audio cue reproduction process 1706, this HRTF 1704 is then convolved with a sound from a sound source 1708 to reproduce the audio cues necessary for spatial localization. In some cases, the HRTF 1704 may undergo post-processing such as bass correction, reverberation addition and headphone equalization prior convolution.

The trained HRTF models may be generated by an HRTF training system part of the HRTF prediction system or in communication with the HRTF prediction system.

The HRTF prediction system 1702 may also include an HRTF model training system 1710 or be in communication with the HRTF model training system 1710. An HRTF model 1712 for generating an HRTF may be trained on various features 1708 of test subjects and actual HRTFs 1714 of the test subjects. The actual HRTFs 1714 for the test subjects may be measured, e.g., in an anechoic chamber via microphones placed in a pinna of the test subjects, or numerically simulated using a boundary or finite element methods in the cloud, on a dedicated compute resource with or without a graphics card, or in a distributed fashion. The HRTF model training system 1710 may apply a classification and/or regression technique such as k-nearest neighbors, support vector machines, decision trees, shallow or deep neural networks etc. to the features 1708 of the test subjects and corresponding actual HRTFs 1714 for the test subjects until a difference between HRTFs output by the HRTF model 1712 and the actual HRTFs 1714 for the test subjects is less than a threshold amount, at which point the HRTF model 1712 is trained and used to determine the HRTF for the user.

FIG. 18A-H illustrates details of training and then applying various HRTF models to generate the HRTF for the user based on the feature vector. The HRTF model may be trained based on respective features of a plurality of test subjects different from the user. Each of the test subject may have certain features which facilitates the training process such that the HRTF model is able to output an accurate HRTF given the features of the test subjects. Then, the feature vector for the user may be input into the trained HRTF model and the HRTF model outputs an HRTF for the user which can be used to spatialize sound. The HRTF may be predicted from combinations of the described approaches, and/or other approaches.

Figure 18A:
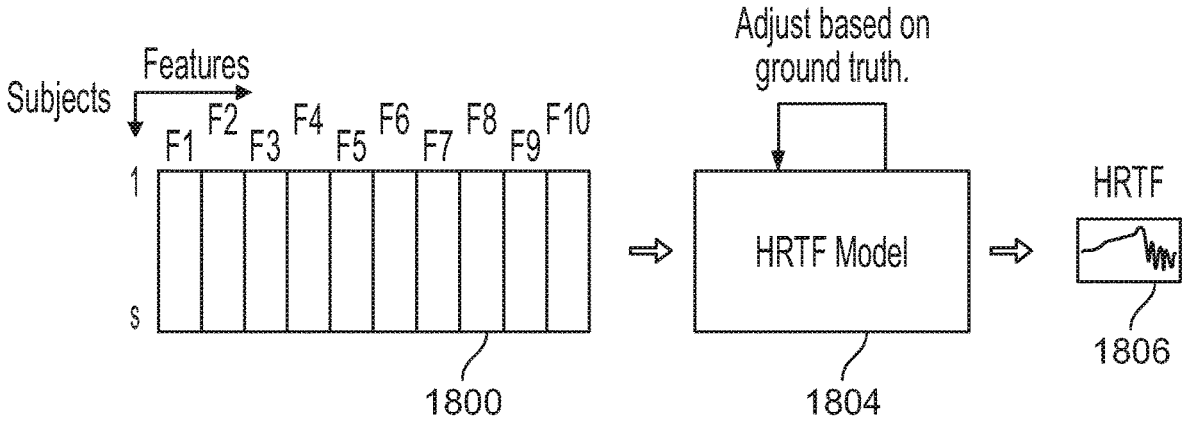
FIGS. 18A-H illustrates details of training various HRTF models based on a feature vector.

In FIG. 18A, each test subject is represented by a concatenated feature set 1800 comprising of one or more of anatomical, demographic and accessory features (F1 to F10). An HRTF model 1804 is trained using these input features. The HRTF model 1804 may receive as an input the concatenated feature set 1800 and output an HRTF 1806. The HRTF 1806 which is output may be compared to a ground truth HRTF. The ground truth HRTF may be the HRTF for the test subject based on a direct measurement or numerical simulation of the HRTF for the test subject. This process may be repeated for the different test subjects and the HRTF model 1804 adjusted to minimize a difference between the ground truth HRTFs for the test subjects and the HRTFs output by the HRTF model 1804. Then, the HRTF prediction system uses the HRTF model 1804 which is trained to determine an HRTF for the user if a concatenated feature set comprising one or more of anatomical, demographic and accessory features (F1 to F10) associated with the user are available. The concatenated feature set is input into the HRTF model 1804 which outputs the personalized HRTF for the user.

Figure 18B:
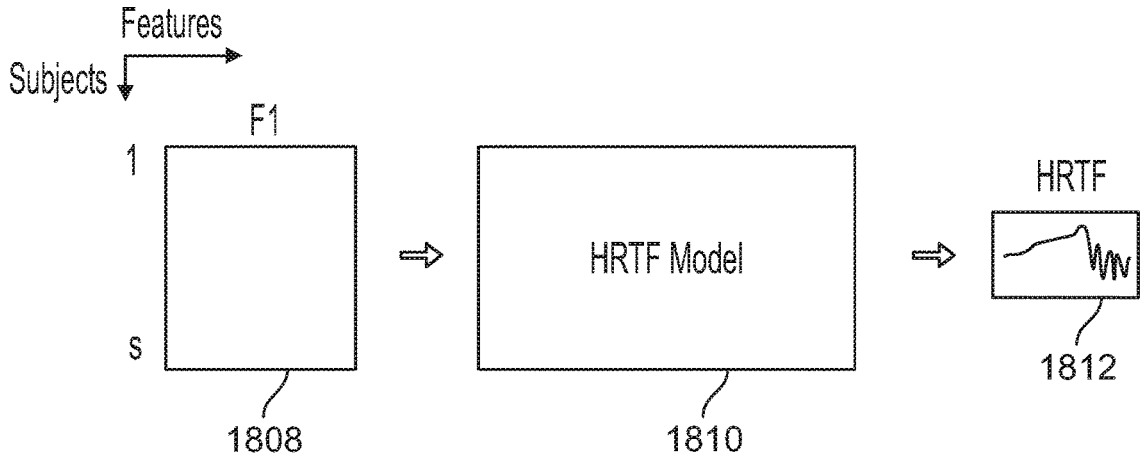

In FIG. 18B, each test subject is represented by a latent vector 1808. An HRTF model 1810 is trained using the latent vector 1808 and a ground truth HRTF associated with the test subject in a manner similar to that described above to minimize a difference between the ground truth HRTFs for the test subjects and the HRTFs 1812 output by the HRTF model 1810. Then, the HRTF prediction system uses the HRTF model 1810 to determine an HRTF for the user if latent features associated with the user are available. The latent features are input into the HRTF model 1810 which outputs the personalized HRTF for the user.

Figure 18C:
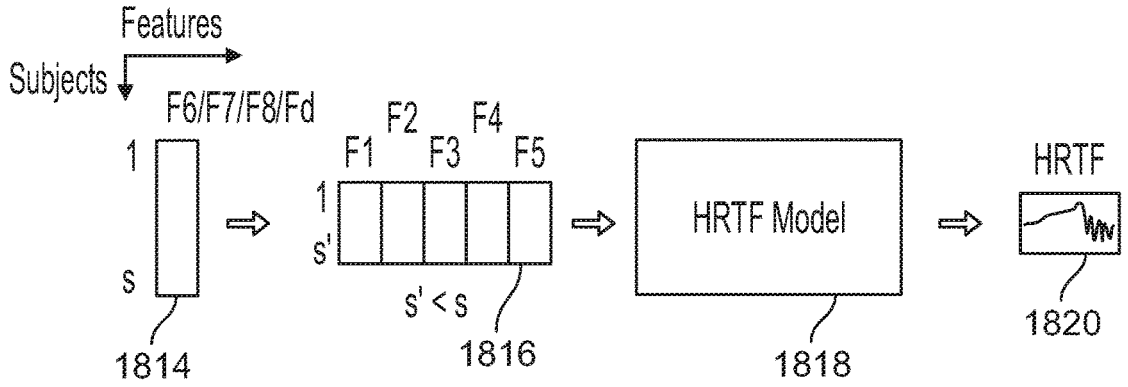

In FIG. 18C, an HRTF model 1818 is trained for a given demographic instead of an entire population. Demographic features Fd (e.g., F6 to F8) 1814 associated with test subjects may be analyzed to categorize test subjects into their respective demographic based on one of multiple concatenated feature vectors. Anatomical features ($F_1$ to $F_5$), and the corresponding ground truth HRTF for test subjects (S'<S) from a given demographic are used to train the HRTF model 1818 for the given demographic to minimize a difference between the ground truth HRTFs for the test subjects and the HRTFs 1820 output by the HRTF model 1818. In this regard, separate HRTF models may be generated for different demographics based on the subjects in the different demographics. Then, the HRTF prediction system uses the HRTF model 1818 to determine an HRTF for the user if demographic features and anatomical features associated with the user are available. The demographic features are used to determine an HRTF model for a demographic and then the anatomical features for the user are input into the HRTF model to determine the personalized HRTF for the user.

Figure 18D:
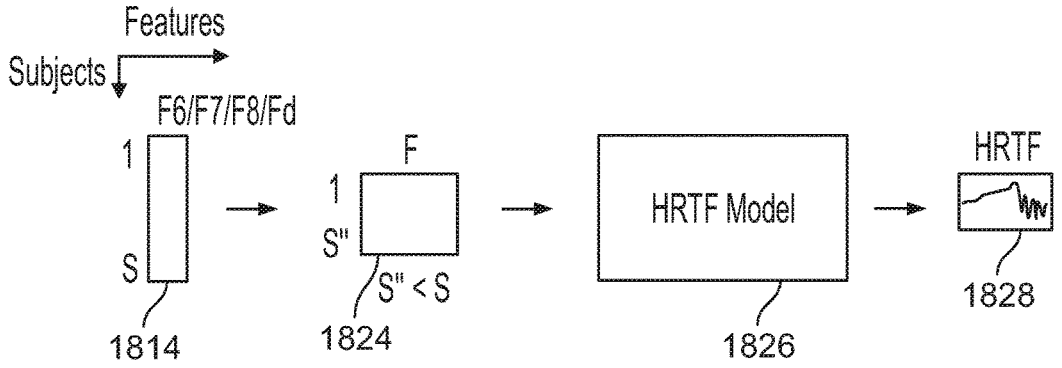

In FIG. 18D, the HRTF model 1826 is also learned specific for a demographic 1814 but instead of using the anatomical features, latent vectors ($F_1$) 1824 and the corresponding ground truth HRTF from a given demographic from a subset of the user population (S'<S) are used to train an HRTF model 1826 to minimize a difference between the ground truth HRTFs for the test subjects and the HRTFs 1828 output by the HRTF model 1826.

Figure 18E:
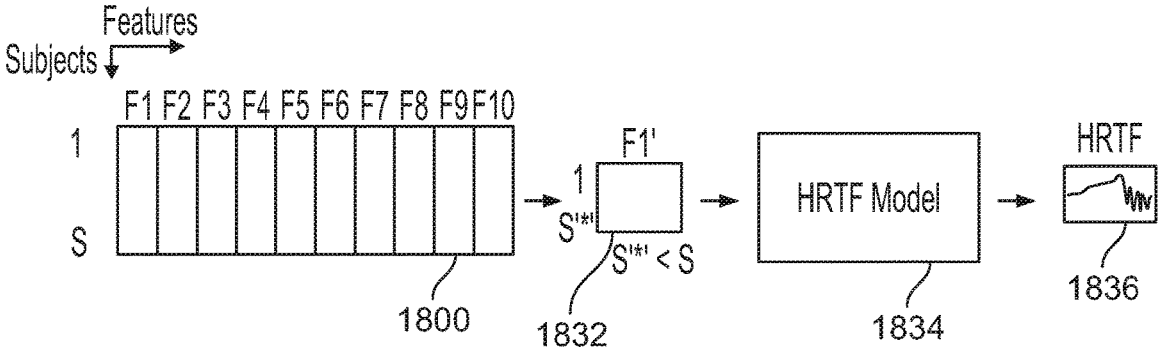

In FIG. 18E, the test subjects are categorized into a given cluster based on one or more of anatomical, demographic, and accessory related features 1800. Then, latent vectors 1832 associated with a subset of the users (S'*'<S) within a given cluster is determined. The features 1800 and latent vector 1832 associated with a given cluster of the test subjects along with the corresponding ground truth HRTFs are then used to train an HRTF model 1834 to output HRTFs 1836 which minimizes a difference with the ground truth HRTFs. Then, the user is categorized into a given cluster based on the one or more of anatomical, demographic and accessory related features associated with the user, a latent vector is determined for the user, and the HRTF prediction system uses the HRTF model 1834 associated with the given cluster to determine the personalized HRTF for the user.

Figure 18F:
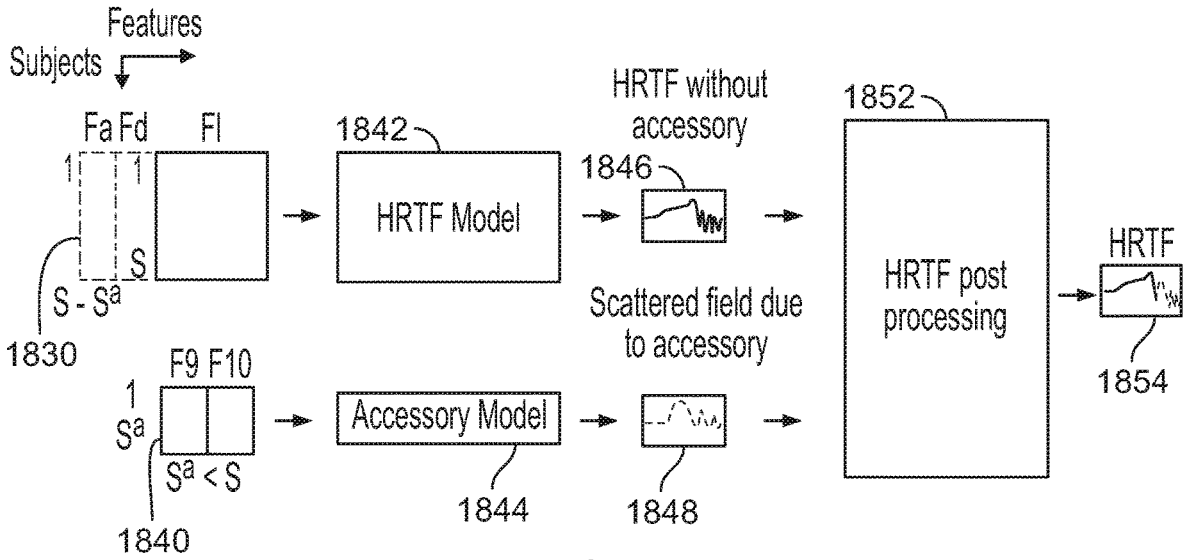

In FIG. 18F, the test subjects are separated into a separate group ($S^a$<S) if they are wearing an accessory. For test subjects not wearing an accessory, one or more of anatomical, demographic and latent vectors 1830, along with the corresponding ground truth HRTFs associated with the test subjects may be used to train an HRTF model 1842 to output HRTFs 1846 which minimize a difference to ground truth HRTFs. An accessory model 1844 may be also be defined which outputs sound pressure produced by features of an accessory worn by a subject. The accessory model 1844 is trained based on inputting various features of the accessory 1840 and a ground truth sound pressure measured for the accessory to minimize a difference between the sound pressure output 1848 by the accessory model 1844 and the ground truth sound pressure. Then, for a user wearing an accessory, the HRTF prediction system inputs one or more of anatomical, demographic, and latent vectors into the model 1842 to determine an HRTF for the user without the accessory, e.g., using the disocclusion logic to determine features of the user without the accessory. Additionally, the HRTF prediction system inputs the features associated with the accessory into the accessory model 1844 to output an indication of sound pressure associated with the accessory. The HRTF and/or sound pressure are then post processed at 1852 (e.g., combined) to determine a personalized HRTF for the user wearing the accessory.

Figure 18G:
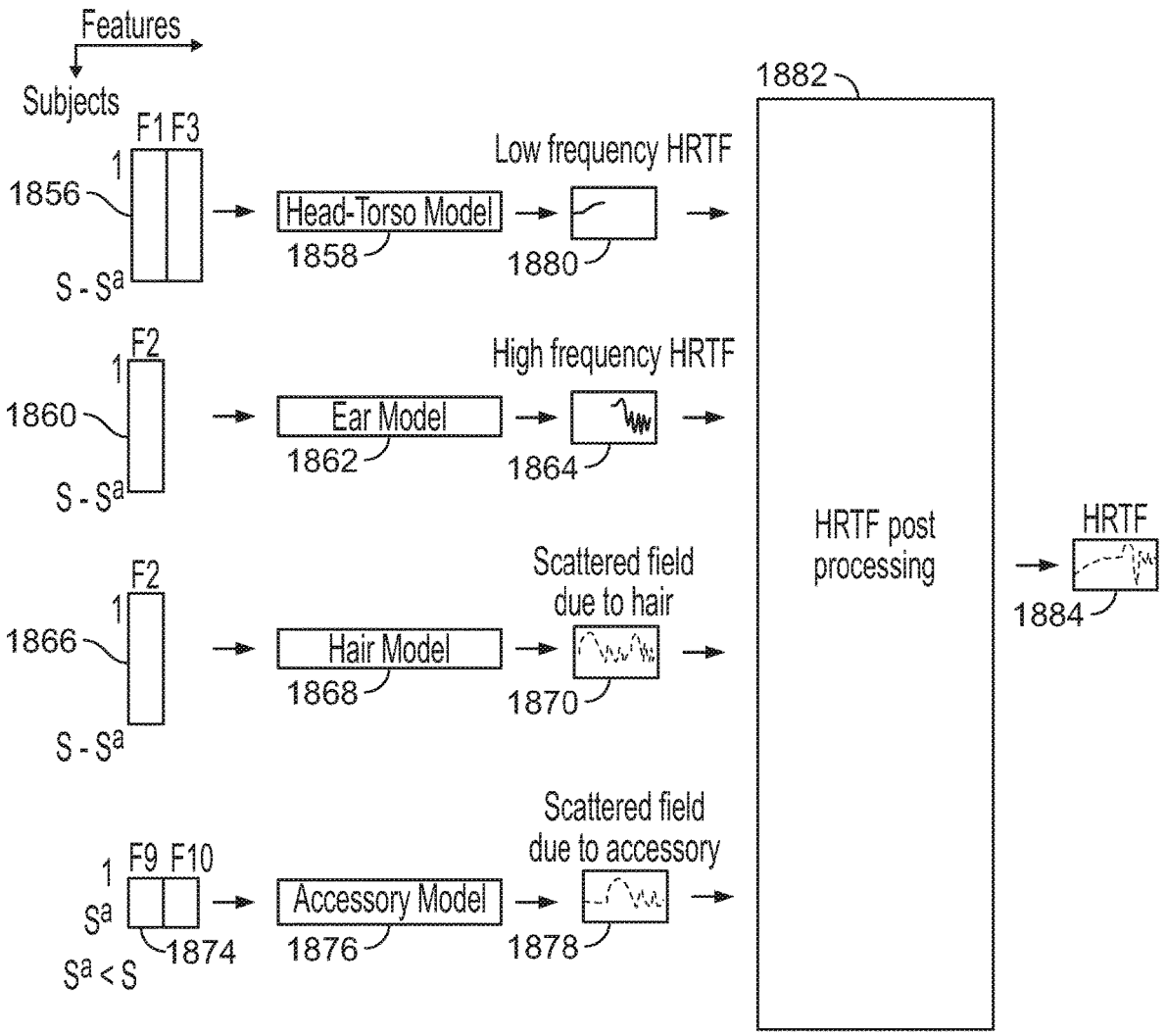

In FIG. 18G, various features may be used to train various models in a manner similar to what is described above. Head and torso features 1856 of a plurality of subjects may be used to train a head and torso model 1858 to output low-frequency HRTFs (e.g., 200 Hz to 5 KHz) 1880 that match corresponding ground truth HRTFs. Pinna features 1860 of plurality of subjects may be used to train an ear model 1862 to output high-frequency HRTFs (e.g., >5 KHz) 1864 that match corresponding ground truth HRTFs. Hair feature 1866 of plurality of subjects may be used to train a hair model 1868 to output scattered responses 1870 due to the scattering of sound by the hair that match corresponding ground truth HRTFs. Accessory features 1874 of a plurality of test subjects may be used to train an accessory model 1876 to output scattered responses 1878 due to the scattering of sound by the accessory that match corresponding ground truth HRTFs. Then, the HRTF prediction system inputs the features associated with a user into an appropriate HRTF model which outputs a respective HRTF and/or response which are post processed at 1882 to generate a personalized HRTF for the user.

Figure 18H:
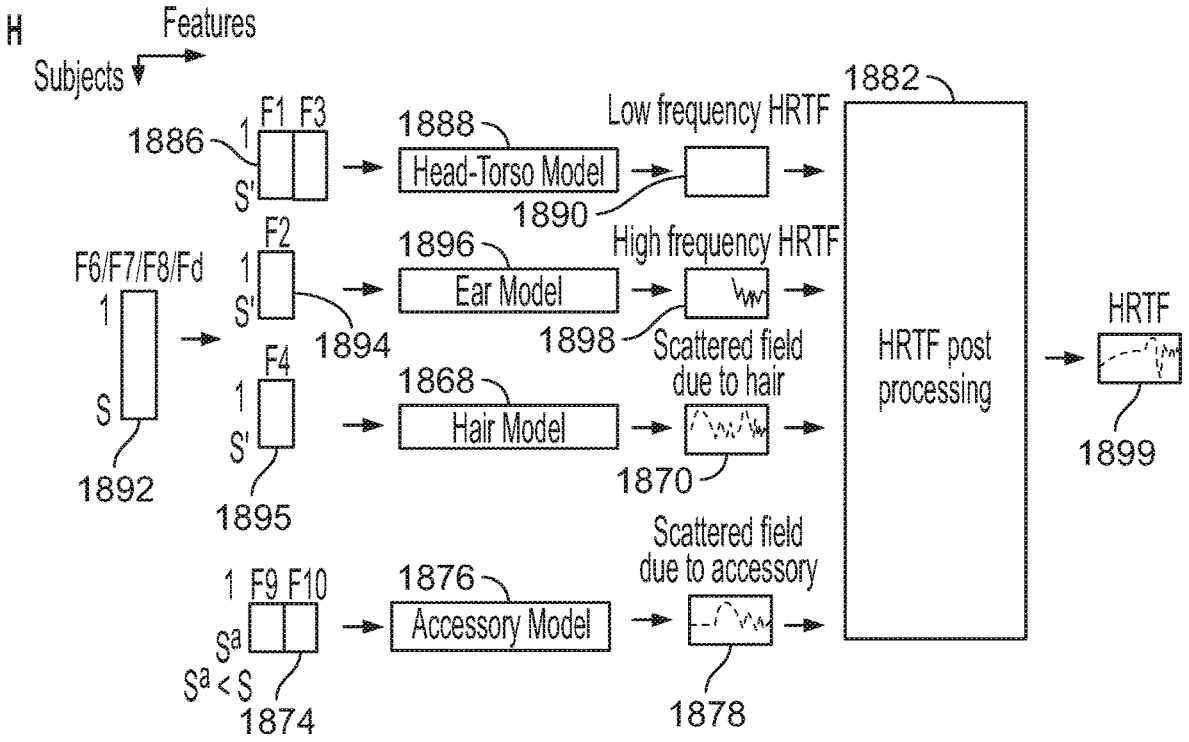

In FIG. 18H, a head-torso model 1888, ear model 1896, and hair model 1868 may be specific to the subject's demography. In such a case, one or more features 1892 associated with test subjects in a population S may be analyzed to determine a population S' of the test subjects, where the population S' is associated with a same demographics. The anatomical features for the head/torso 1886, the pinna 1894 and the hair 1895 associated with test subjects of the demographic and ground truths are then used to train respective HRTF models. The HRTF models include a low-frequency HRTF 1890, the high frequency HRTF 1898, the scattered field response due to hair 1870 and the scattered field response due to accessories 1878 provided by the accessory model 1876. Then, the HRTF prediction system inputs the features associated with a head/torso, pinna, and hair of a user of a given demographic into an appropriate HRTF model which outputs a respective HRTF and/or response which are post processed at 1882 to generate a personalized HRTF for the user.

Figure 19:
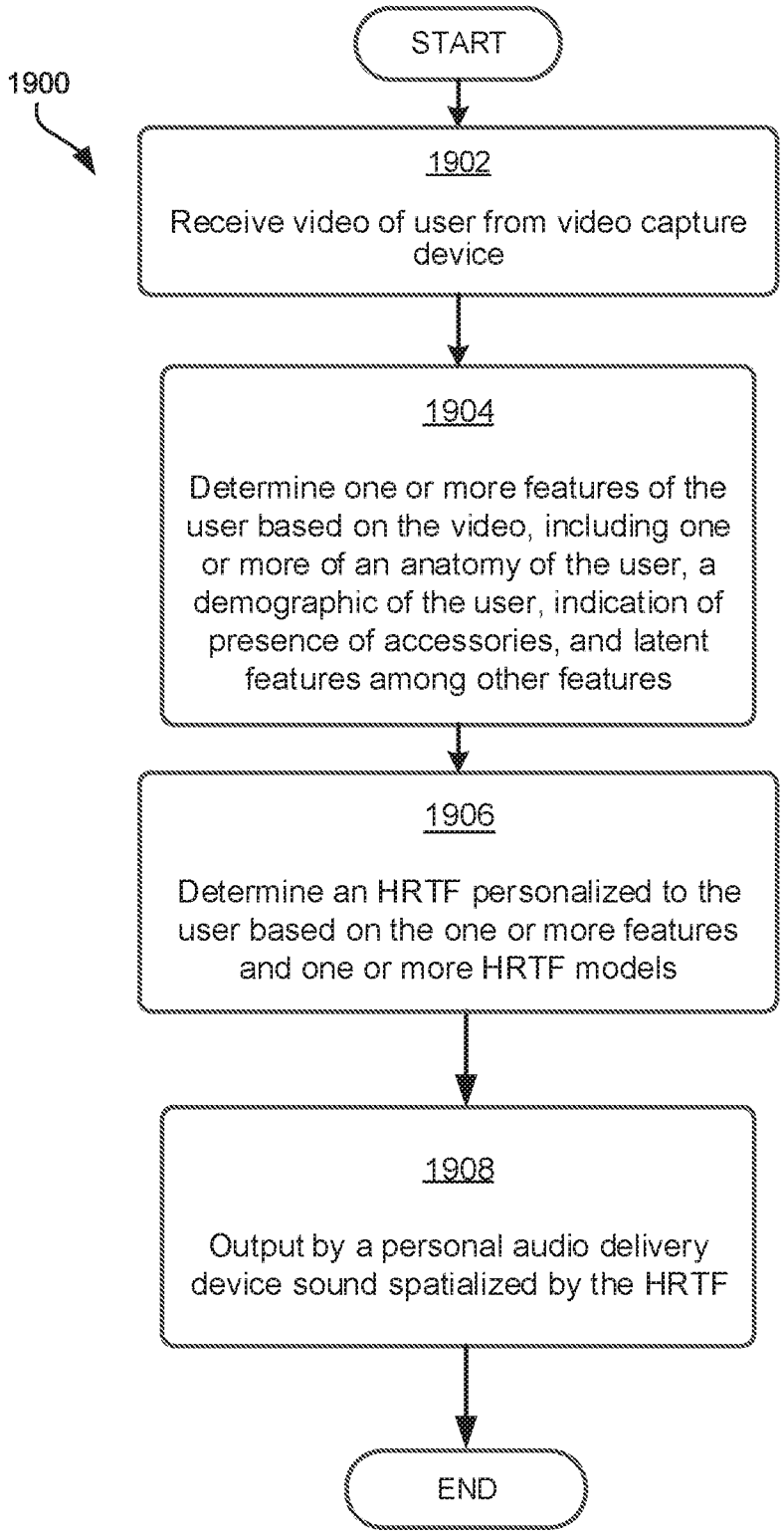
FIG. 19 is a flow chart of functions associated with personalizing an HRTF for the user based on a feature vector.

FIG. 19 is a flow chart of functions 1900 associated with personalizing an HRTF for the user based on features associated with the user. At 1902, a video is received from a video capture device. The video is captured from a front facing camera of the video capture device where a display screen of the video capture device displays the video captured in real time to a user. Images of the video may identify a pinna and head of the user. At 1904, one or more features associated with the user is determined from one or more identified images of the video. The features may include one or more of an anatomy of the user, a demographic of the user, indication of presence of accessories, and latent features, among other features. In some cases, the features may be based on a 3D representation of the user constructed from the images which are a 2D representation of the user. In some cases, the features may be based on determining 2D and/or 3D representations of the accessories and/or 2D and/or 3D representations of the user without the accessories. At 1906, a head related transfer function (HRTF) personalized to the user is determined based on the one or more features and one or more HRTF models. The HRTF is generated from the one or more HRTF models trained during a training process and based on the determined features as described above and/or with respect to FIG. 18. The features are analyzed and input into selected one or more HRTF models to determine the personalized HRTF. At 1908, the HRTF is used to spatialize sound output by a personal audio delivery device.

Figure 20:
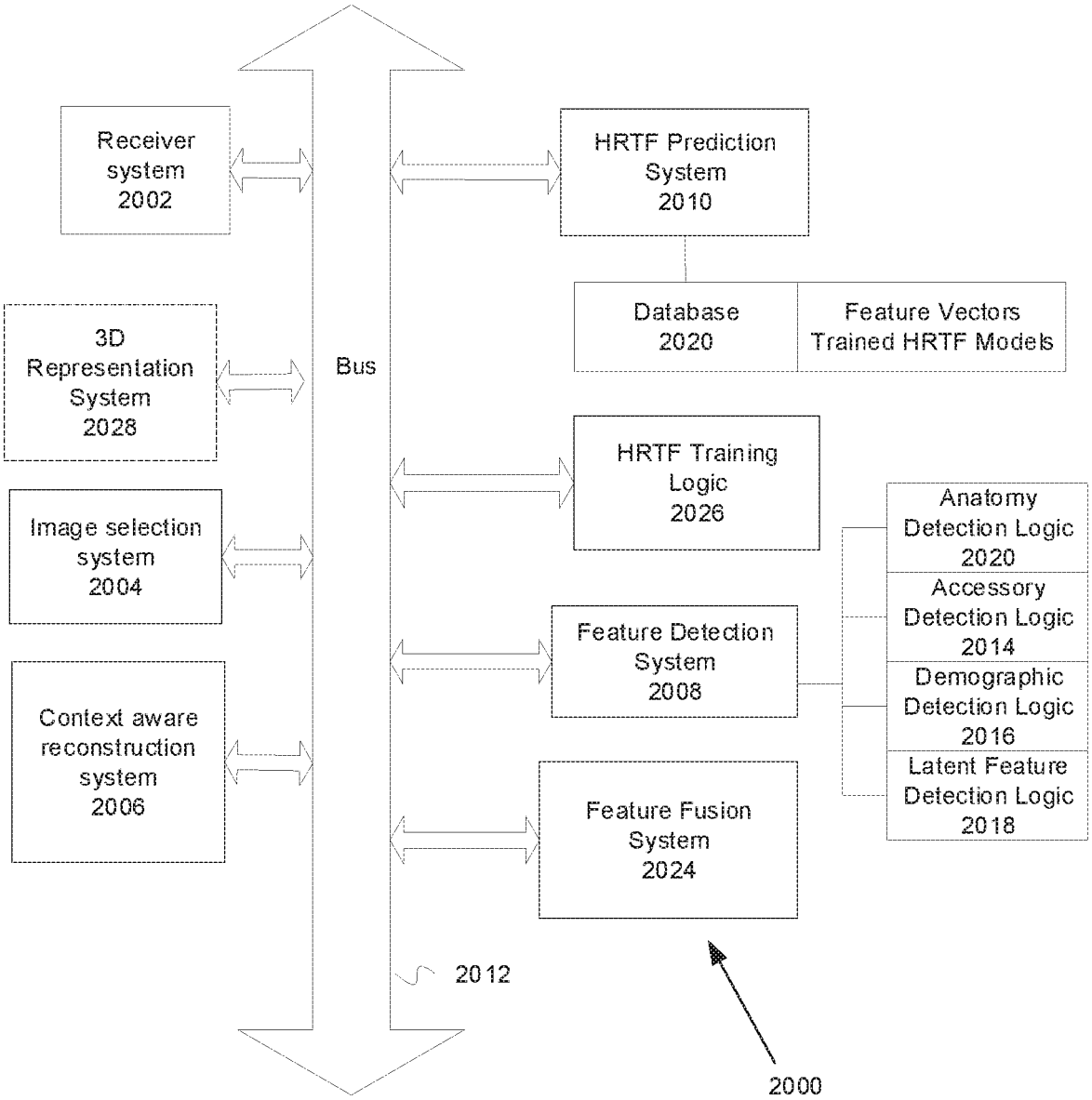
FIG. 20 is a block diagram a computer system for determining a personalized HRTF.

FIG. 20 is a block diagram a computer system 2000 for determining a personalized HRTF. The computer system 2000 may include a receiver system 2002 for receiving a captured video from a video capture device. The computer system 2000 may also include the image selection system 2004, context aware reconstruction system 2006, feature detection system 2008, and HRTF prediction system 2010 coupled to a bus 2012. The bus 2012 may communicatively couple together the one or more systems. Further, in some cases, the computer system 2000 may be one or more computer systems such as a public or private computer, a cloud server, or dedicated computer system, in which case, the bus 2012 may take the form of wired or wireless communication networks. The feature detection system 2008 may include the accessory detection logic 2014, demographic detection logic 2016, latent feature detection logic 2018, and anatomy detection logic 2020. The HRTF prediction system 2010 may have access to a database 2022 via the bus 2012 with feature vectors and one or more trained HRTF models. The feature vectors may be generated by the feature fusion system 2024 and stored in the database 2020. The computer system 2000 may also include HRTF training logic 2026 for training one or more HRTFs in a manner similar to that described above and with respect to FIG. 18A-H. The personalized HRTF can be used to spatialize sound for a user wearing a personal audio delivery device. In some cases, the computer system 2000 may also have 3D representation system 2028 for determining a 3D representation of a user for purposes of determining 3D features of the user based on 2D images associated with the video received by the receiver system 2002.

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "example" and/or "embodiment" means that a particular feature, structure, or characteristic described in connection with the example and/or embodiment can be included in at least one example and/or embodiment of an invention. The appearances of this phrase in various places in the specification are not necessarily all referring to the same example and/or embodiment, nor are separate or alternative examples and/or embodiments mutually exclusive of other examples and/or embodiments. As such, the example and/or embodiment described herein, explicitly and implicitly understood by one skilled in the art, can be combined with other examples and/or embodiments.

Still additionally, references herein to "training" means learning a model from a set of input and output data through an iterative process. The training process involves, for example, minimization of a cost function which describes the error between the predicted output and the ground truth output.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

EXAMPLE EMBODIMENTS

Example embodiments include the following:

Embodiment 1

A method comprising: receiving a video from a video capture device, wherein the video is captured from a front facing camera of the video capture device and wherein a display screen of the video capture device displays the video captured in real time to a user; identifying one or more images of the video, wherein the one or more images identifies a pinna and head of the user; automatically determining one or more features associated with the user based on the one or more images, wherein the one or more features include an anatomy of the user, a demographic of the user, a latent feature of the user, and indication of an accessory worn by the user; and based on the one or more features, determining a head related transfer function (HRTF) which is personalized to the user.

Embodiment 2

The method of Embodiment 1, wherein determining the head related transfer function comprises determining a demographic of the user based on the one or more features and inputting the one or more features into an HRTF model associated with the demographic which outputs the head related transfer function personalized to the user.

Embodiment 3

The method of Embodiments 1 or 2, further comprising removing the indication of the accessory worn by the user from an image of the one or more images; and determining the one or more features based on the image with the indication of the accessory removed.

Embodiment 4

The method of any of Embodiments 1-3, wherein removing the indication of the accessory worn by the user comprises replacing pixels in the image of the one or more images with skin tone pixels.

Embodiment 5

The method of any of Embodiments 1-4, wherein the demographics includes one or more of a race, age, and gender of the user.

Embodiment 6

The method of any of Embodiments 1-5, further comprise determining a weight vector based on the one or more images; applying the weight vector to a 3D generic representation of a human to determine a 3D representation of the user; wherein the 3D representation includes 3D features; and wherein determining the head related transfer function personalized to the user comprises determining the head related transfer function based on the 3D features.

Embodiment 7

The method of any of Embodiments 1-6, wherein the video is a continuous sequence of images which begins with showing a head of the user, then a pinna of the user, followed by the head of the user, another pinna of the user, and ending with the head of the user while the video capture device is stationary.

Embodiment 8

The method of any of Embodiments 1-7, further comprising outputting spatialized sound based on the personalized HRTF to a personal audio delivery device.

Embodiment 9

The method of any of Embodiments 1-8, wherein determining the head related transfer function (HRTF) comprises inputting first features of the one or more features into a first HRTF model which outputs a first HRTF, second features of the one or more features into a second HRTF model which outputs a second HRTF, and combining the first and second HRTF to determine the HRTF personalized to the user.

Embodiment 10

The method of any of Embodiments 1-9, wherein the first features are associated with the head of the user and the second features are associated with the pinna of the user.

Embodiment 11

The method of any of Embodiments 1-10, further comprising inputting third features into a model indicative of sound scatter by the accessory, and combining the first and second HRTF and the sound scatter to determine the HRTF personalized to the user.

Embodiment 12

A system comprising: a personal audio delivery device; a video capture device having a front facing camera and a display screen; computer instructions stored in memory and executable by a processor to perform the functions of: receiving a video from the video capture device, wherein the video is captured from the front facing camera of the video capture device and wherein the display screen of the video capture device displays the video captured in real time to a user; identifying one or more images of the video, wherein the one or more images identifies a pinna and head of the user; automatically determining one or more features associated with the user based on the one or more images, wherein the one or more features include an anatomy of the user, a demographic of the user, a latent feature of the user, and indication of an accessory worn by the user; based on the one or more features, determining a head related transfer function (HRTF) which is personalized to the user; and outputting spatialized sound based on the personalized HRTF to the personal audio delivery device.

Embodiment 13

The system of Embodiment 12, further comprising computer instructions stored in memory and executable by the processor to remove the indication of the accessory worn by the user from an image of the one or more images; and determine the one or more features based on the image with the indication of the accessory removed.

Embodiment 14

The system of Embodiments 12 or 13, wherein the computer instructions stored in memory and executable by the processor for removing the indication of the accessory worn by the user comprises replacing pixels in the image of the one or more images with skin tone pixels.

Embodiment 15

The system of any of Embodiments 12-14, wherein the demographics includes one or more of a race, age, and gender of the user.

Embodiment 16

The system of Embodiments 12-15, further comprising computer instructions stored in memory and executable by the processor for determining a weight vector based on the one or more images; apply the weight vector to a 3D generic representation of a human to determine a 3D representation of the user; wherein the 3D model includes 3D features; and wherein the computer instructions stored in memory and executable by the processor for determining the head related transfer function personalized to the user comprises determining the head related transfer function based on the 3D features.

Embodiment 17

The system of Embodiments 12-16, wherein the video is a continuous sequence of images which begins with showing a head of the user, then a pinna of the user, followed by the head of the user, another pinna of the user, and ending with the head of the user while the video capture device is stationary.

Embodiment 18

The system of Embodiments 12-17, wherein the computer instructions stored in memory and executable by the processor for determining the head related transfer function (HRTF) comprises computer instructions for inputting first features of the one or more features into a first HRTF model which outputs a first HRTF, second features of the one or more features into a second HRTF model which outputs a second HRTF, and combining the first and second HRTF to determine the HRTF personalized to the user.

Embodiment 19

The system of Embodiments 12-18, wherein the first features are associated with the head of the user and the second features are associated with the pinna of the user.

Embodiment 20

The system of Embodiments 12-19, further comprising computer instructions stored in memory and executable by the processor for inputting third features into a model indicative of sound scatter by the accessory, and combining the first and second HRTF and the sound scatter to determine the HRTF personalized to the user.

We claim:

1. A method comprising:

receiving a video from a video capture device, wherein the video is captured from a front facing camera of the video capture device and wherein a display screen of the video capture device displays the video captured in real time to a user;

identifying one or more images of the video, wherein the one or more images identifies a pinna and head of the user;

automatically determining one or more features associated with the user based on the one or more images, wherein the one or more features include at least one of an anatomy of the user, a demographic of the user, a latent feature of the user, or indication of an accessory worn by the user; and based on the one or more features, determining a head related transfer function (HRTF) which is personalized to the user;

wherein determining the head related transfer function (HRTF) comprises inputting first features of the one or more features into a first HRTF model which outputs a first HRTF, second features of the one or more features into a second HRTF model which outputs a second HRTF, and combining the first and second HRTF to determine the HRTF personalized to the user.

2. The method of claim 1, wherein determining the head related transfer function comprises determining a demographic of the user based on the one or more features and inputting the one or more features into an HRTF model associated with the demographic which outputs the head related transfer function personalized to the user.

3. The method of claim 1, further comprising removing the indication of the accessory worn by the user from an image of the one or more images; and determining the one or more features based on the image with the indication of the accessory removed.

4. The method of claim 3, wherein removing the indication of the accessory worn by the user comprises replacing pixels in the image of the one or more images with skin tone pixels.

5. The method of claim 1, wherein the demographics includes one or more of a race, age, and gender of the user.

6. The method of claim 1, further comprise determining a weight vector for the user; applying the weight vector to a 3D generic representation of a human to determine a 3D user representation of the user; wherein the 3D user representation includes 3D features; and wherein determining the head related transfer function personalized to the user comprises determining the head related transfer function based on the 3D features of the 3D user representation.

7. The method of claim 1, wherein the video is a continuous sequence of images which begins with showing a head of the user, then a pinna of the user, followed by the head of the user, another pinna of the user, and ending with the head of the user while the video capture device is stationary.

8. The method of claim 1, further comprising outputting spatialized sound based on the personalized HRTF to a personal audio delivery device.

9. The method of claim 1, wherein the first features are associated with the head of the user and the second features are associated with the pinna of the user.

10. The method of claim 1, further comprising inputting third features into a model indicative of sound scatter by the accessory, and combining the first and second HRTF and the sound scatter to determine the HRTF personalized to the user.

11. The method of claim 1, further comprising determining a weight vector for the user, wherein the weight vector comprises a plurality of entries; and wherein each entry indicate a size of a feature associated with the anatomy of the user; adjusting sizes of features of a 3D generic representation of a human to determine a 3D user representation based on the corresponding sizes of features indicated by the entries in the weight vector; wherein the 3D user representation includes 3D features; and wherein determining the head related transfer function personalized to the user comprises determining the head related transfer function based on the 3D features of the 3D user representation.

12. The method of claim 1, further comprising removing the indication of the accessory worn by the user from an image of the one or more images; and determining the one or more features based on the image with the indication of the accessory removed, wherein the accessory is an earring.

13. The method of claim 1, wherein automatically determining one or more features associated with the user based on the one or more images, wherein the one or more features include at least one of an anatomy of the user, a demographic of the user, a latent feature of the user, or indication of an accessory worn by the user comprises automatically determining one or more features associated with the user based on the one or more images, wherein the one or more features include the anatomy of the user, the demographic of the user, the latent feature of the user, and indication of the accessory worn by the user.

14. The method of claim 1, wherein the first features are a first subset of the one or more features and the second features are a second subset of the one or more features.

15. A system comprising:

a personal audio delivery device;

a video capture device having a front facing camera and a display screen;

computer instructions stored in memory and executable by a processor to perform the functions of:

receiving a video from the video capture device, wherein the video is captured from the front facing camera of the video capture device and wherein the display screen of the video capture device displays the video captured in real time to a user;

identifying one or more images of the video, wherein the one or more images identifies a pinna and head of the user;

automatically determining one or more features associated with the user based on the one or more images, wherein the one or more features include at least one of an anatomy of the user, a demographic of the user, a latent feature of the user, or indication of an accessory worn by the user;

based on the one or more features, determining a head related transfer function (HRTF) which is personalized to the user; and outputting spatialized sound based on the personalized HRTF to the personal audio delivery device;

wherein the computer instructions stored in memory and executable by the processor for determining the head related transfer function (HRTF) comprises computer instructions for inputting first features of the one or more features into a first HRTF model which outputs a first HRTF, second features of the one or more features into a second HRTF model which outputs a second HRTF, and combining the first and second HRTF to determine the HRTF personalized to the user.

16. The system of claim 15, further comprising computer instructions stored in memory and executable by the processor to remove the indication of the accessory worn by the user from an image of the one or more images; and determine the one or more features based on the image with the indication of the accessory removed.

17. The system of claim 15, wherein the computer instructions stored in memory and executable by the processor for removing the indication of the accessory worn by the user comprises replacing pixels in the image of the one or more images with skin tone pixels.

18. The system of claim 15, wherein the demographics includes one or more of a race, age, and gender of the user.

19. The system of claim 15, further comprising computer instructions stored in memory and executable by the processor for determining a weight vector for the user; apply the weight vector to a 3D generic representation of a human to determine a 3D user representation; wherein the 3D user representation includes 3D features; and wherein the computer instructions stored in memory and executable by the processor for determining the head related transfer function personalized to the user comprises determining the head related transfer function based on the 3D features of the 3D user representation.

20. The system of claim 15, wherein the video is a continuous sequence of images which begins with showing a head of the user, then a pinna of the user, followed by the head of the user, another pinna of the user, and ending with the head of the user while the video capture device is stationary.

21. The system of claim 15, wherein the first features are associated with the head of the user and the second features are associated with the pinna of the user.

22. The system of claim 15, further comprising computer instructions stored in memory and executable by the processor for inputting third features into a model indicative of sound scatter by the accessory, and combining the first and second HRTF and the sound scatter to determine the HRTF personalized to the user.

* * * * *